US008311448B2

(12) United States Patent
Hashimoto

(10) Patent No.: US 8,311,448 B2
(45) Date of Patent: Nov. 13, 2012

(54) IMAGE FORMING APPARATUS

(75) Inventor: Yohei Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 274 days.

(21) Appl. No.: 12/857,645

(22) Filed: Aug. 17, 2010

(65) Prior Publication Data

US 2011/0052254 A1 Mar. 3, 2011

(30) Foreign Application Priority Data

Aug. 28, 2009 (JP) ..... 2009-198010
Apr. 7, 2010 (JP) ..... 2010-088904

(51) Int. Cl.
*G03G 15/00* (2006.01)

(52) U.S. Cl. ..... 399/110; 399/111; 399/114

(58) Field of Classification Search ..... 399/107, 399/110–114
See application file for complete search history.

(56) References Cited

U.S. PATENT DOCUMENTS

| | | | | |
|---|---|---|---|---|
| 7,813,671 | B2 * | 10/2010 | Nittani et al. | 399/113 |
| 7,907,868 | B2 * | 3/2011 | Igarashi et al. | 399/110 |
| 2003/0161656 | A1 | 8/2003 | Miura et al. | |
| 2007/0147887 | A1 | 6/2007 | Hattori | |

FOREIGN PATENT DOCUMENTS

| | | | |
|---|---|---|---|
| JP | 06-083119 | A | 3/1994 |
| JP | 10-260566 | | 9/1998 |
| JP | 10-301463 | | 11/1998 |
| JP | 2003-316233 | | 11/2003 |
| JP | 2004-294911 | A | 10/2004 |
| JP | 2007-178656 | | 7/2007 |

OTHER PUBLICATIONS

CN Office Action dtd Apr. 13, 2012, CN Appln. 201010269096.3, English translation.
JP Office Action dated Jun. 28, 2011; JP Application No. 2010-088904. English Translation.

* cited by examiner

*Primary Examiner* — Hoan Tran
(74) *Attorney, Agent, or Firm* — Banner & Witcoff, Ltd.

(57) ABSTRACT

An image forming apparatus is provided. The image forming apparatus includes: an apparatus main body, a drawer, an image carrier, a developing unit which is provided to be movable with respect to the drawer, a contacting and spacing mechanism which is provided to at least one of the apparatus main body and the drawer, and which is configured to move the developing unit between a contacting position and a spacing position, a driving unit which is configured to drive the contacting and spacing mechanism, a cover, an interlocking mechanism which is configured to interlock with opening of the cover, wherein when the cover is opened, the interlocking mechanism performs a first operation of releasing the coupled state between the driving unit and the contacting and spacing mechanism, and a second operation of moving the developing unit to a drawn position while interlocking with the first operation.

11 Claims, 23 Drawing Sheets

IMAGE FORMING APPARATUS

CROSS-REFERENCE TO RELATED APPLICATIONS

This application claims priority from Japanese Patent Application No. 2009-198010 filed on Aug. 28, 2009, and from Japanese Patent Application No. 2010-088904 filed on Apr. 7, 2010, the entire contents of which are incorporated herein by reference.

TECHNICAL FIELD

Aspects of the present invention relate to an image forming apparatus.

BACKGROUND

A related-art image forming apparatus includes an apparatus main body, a drawer which is provided to be removable with respect to the apparatus main body, an image carrier which is held by the drawer and on which an electrostatic latent image is formed, and a developing unit which is provided to be movable with respect to the drawer, and which supplies toner to the image carrier to make the electrostatic latent image into a visible image.

Further, the image forming apparatus further includes a contacting and spacing mechanism which is provided in the apparatus main body, and which moves the developing unit between a contacting position which is a position at which the developing unit contacts the image carrier and a spacing position which is a position at which the developing unit is spaced from the image carrier, in a state where the drawer is loaded in the apparatus main body, a driving unit which is provided in the apparatus main body, and which drives the contacting and spacing mechanism in a state where the driving unit is in a coupled state with the contacting and spacing mechanism, and a cover which covers a front face of the apparatus main body, and is opened when drawing the drawer from the apparatus main body.

The apparatus main body includes, in the upper portion of the front face side thereof, a clutch switching lever which moves forward from an initial position to release the coupled state between the driving unit and the contacting and spacing mechanism, and a lever forward-backward mechanism which engages with a handling piece provided at the cover to hold the clutch switching lever at the initial position when the cover is closed, and which separates from the handling piece to move the clutch switching lever forward when the cover is open.

Further, the apparatus main body includes, in the lower portion of the front surface side thereof, a cover interlocking-moving member which is coupled with the cover via a link mechanism (not shown), and which moves forward while interlocking with an opening operation of the cover, and a second clutch mechanism which transmits a moving operation of the cover interlocking-moving member as a driving force to the contacting and spacing mechanism, to move the developing unit to a drawn position which is a position of the developing unit with respect to the image carrier for allowing the drawer to be removed from the apparatus main body.

In this image forming apparatus, when a user opens the cover to remove the drawer from the apparatus main body, the lever forward-backward mechanism and the clutch switching lever operate via the handling piece to release the coupled state between the driving unit and the contacting and spacing mechanism, and the cover interlocking-moving member and the second clutch mechanism operate via the link mechanism to move the developing unit to the drawn position (spacing position).

However, since the related-art image forming apparatus has a configuration in which the mechanism group of "the handling piece, the lever forward-backward mechanism, and the clutch switching lever" and the mechanism group of "the link mechanism, the cover interlocking-moving member, and the second clutch mechanism" separately operate according to an opening operation of the cover, the apparatus is made complicated and the number of components is large. Further, it is necessary to secure spaces for providing these mechanism groups in the apparatus main body, which causes the problem that it is difficult to downsize the apparatus.

SUMMARY

Accordingly, it is an aspect of the present invention to provide an image forming apparatus which allows a drawer including an image carrier and a developing unit to be drawn from the apparatus main body. Additionally, downsizing of the apparatus can be achieved thereby.

According to an illustrative embodiment of the present invention, there is provided an image forming apparatus comprising: an apparatus main body having an opening; a drawer which is provided to be loadable to and drawable from the apparatus main body through the opening; an image carrier which is held by the drawer and on which an electrostatic latent image is formed; a developing unit which is provided to be movable with respect to the drawer, and which is configured to supply toner to the image carrier to make the electrostatic latent image into a visible image; a contacting and spacing mechanism which is provided to at least one of the apparatus main body and the drawer, and which is configured to move the developing unit between a contacting position at which the developing unit contacts the image carrier and a spacing position at which the developing unit is spaced from the image carrier, in a state where the drawer is loaded in the apparatus main body; a driving unit which is provided in the apparatus main body, and which is configured to drive the contacting and spacing mechanism in a state where the driving unit is in a coupled state with the contacting and spacing mechanism; a cover which is configured to cover the opening, and which is opened when drawing the drawer from the apparatus main body; and an interlocking mechanism which is configured to change in at least one of position, posture, and form thereof while interlocking with opening of the cover, wherein while the change of the interlocking mechanism interlocking with opening of the cover is caused, the interlocking mechanism performs a first operation of releasing the coupled state between the driving unit and the contacting and spacing mechanism, and a second operation of moving the developing unit to a drawn position while interlocking with the first operation, and wherein the drawn position is a position of the developing unit with respect to the image carrier for allowing the drawer to be loaded in and drawn from the apparatus main body and is one of the contacting position and the spacing position.

DETAILED DESCRIPTION

Hereinafter, a first illustrative embodiment and a second illustrative embodiment in which an image forming apparatus of the present invention is implemented will be described with reference to the drawings.

(First Illustrative Embodiment)

Figure 1:
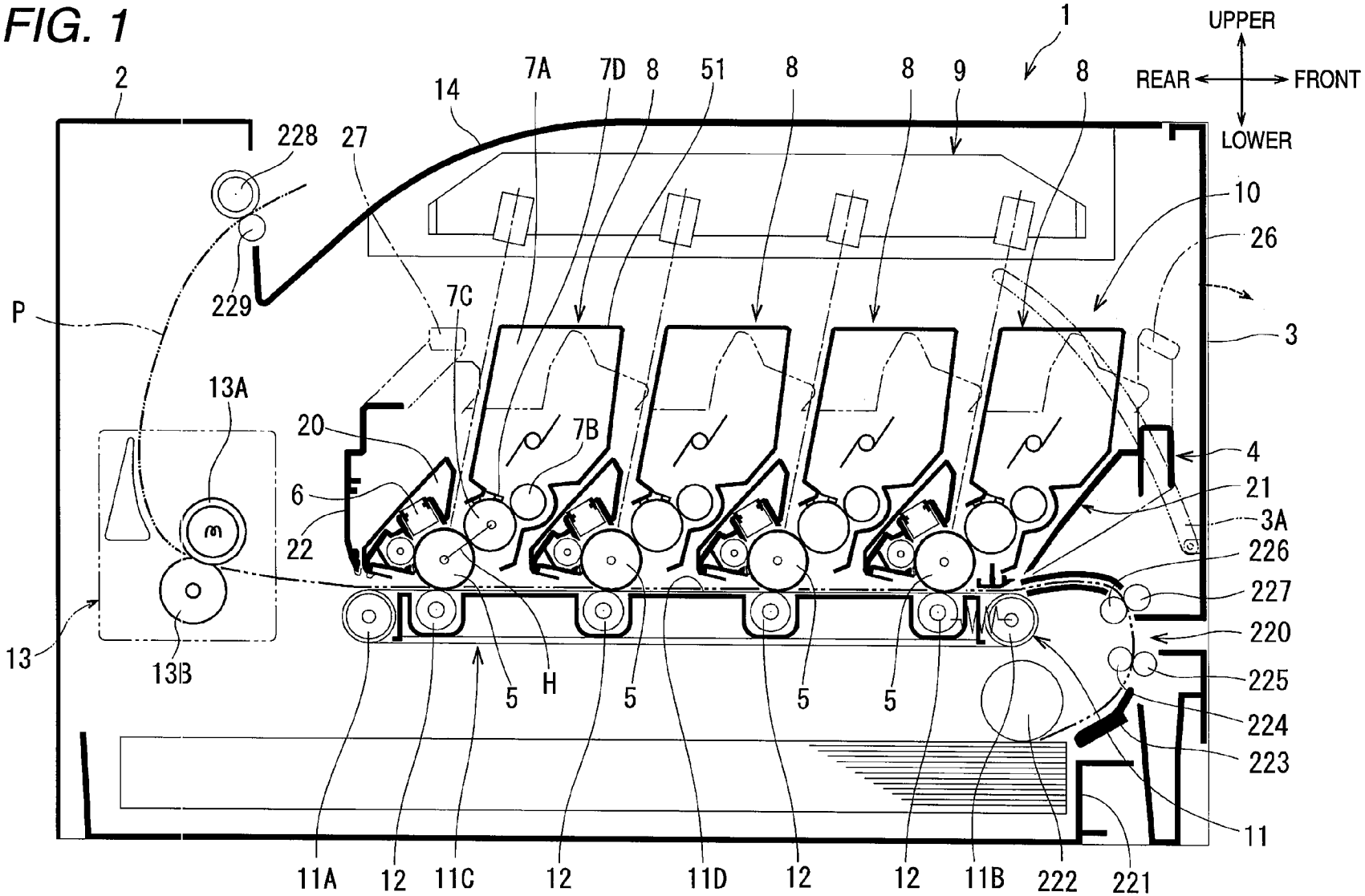
FIG. 1 is a schematic cross-sectional view of an image forming apparatus according to a first illustrative embodiment.

As shown in FIG. 1, a printer 1 is a color laser printer that forms color images on sheets (including OHP sheets, etc.) as media to be recorded by an electrophotographic system. In FIG. 1, the right side of the sheet plane is defined as the front side of the apparatus and the left side of the sheet plane is defined as the rear side of the apparatus. Further, the side of a left hand when the apparatus is viewed from the front side (the front surface side of the sheet plane) is defined as the left side, and the opposite side (the back surface side of the sheet plane) is defined as the right side. Based on these definitions, the front and rear, right and left, and vertical directions, respectively, are indicated in FIG. 1. Then, the respective directions shown in FIGS. 2 to 23 are all indicated so as to correspond to the respective directions shown in FIG. 1. Hereinafter, respective components included in the printer 1 will be described on the basis of FIG. 1.

1. Schematic Configuration

Figure 4:
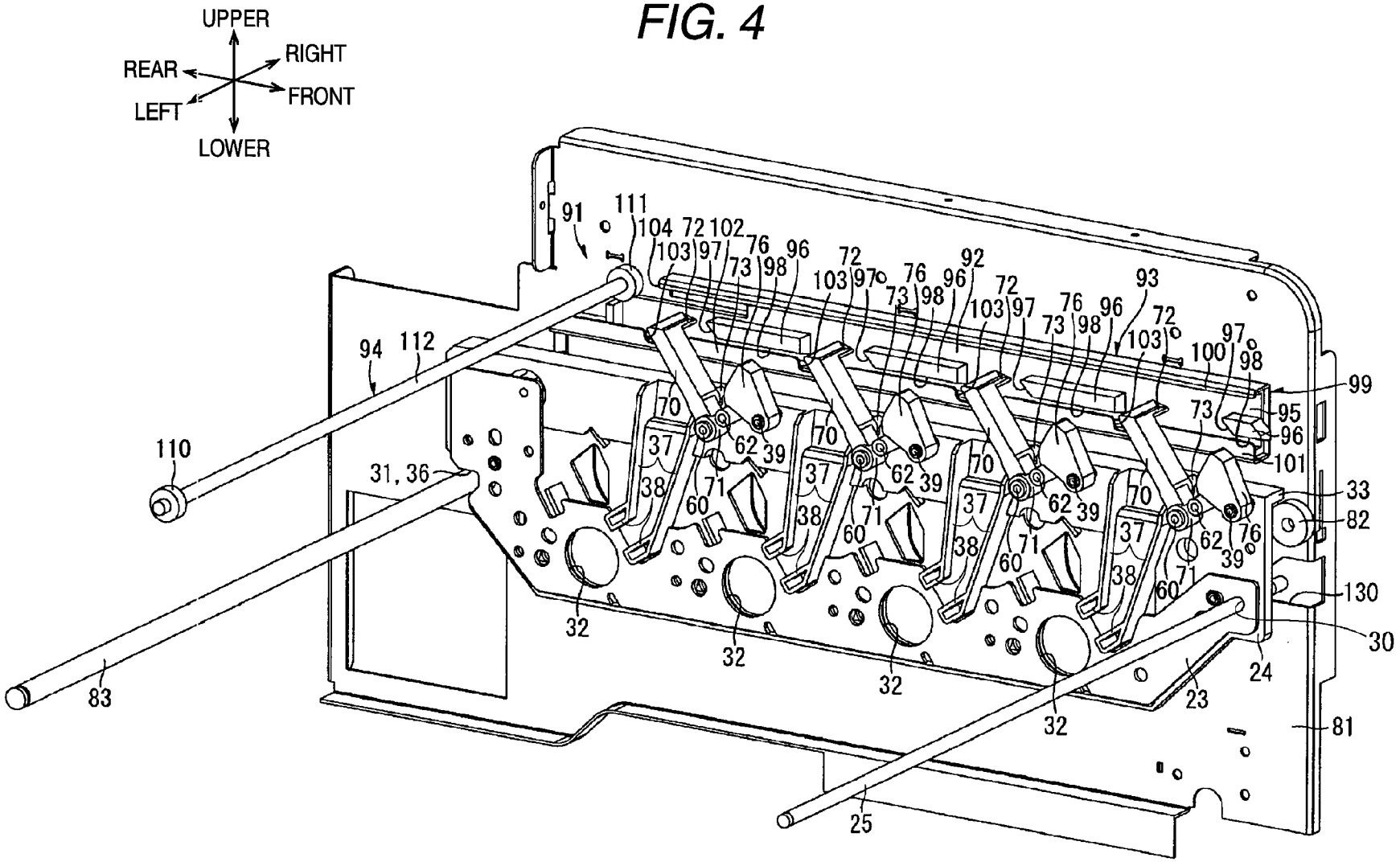
FIG. 4 is a main portion perspective view of the image forming apparatus according to the first illustrative embodiment, in a state where all developing units are at their contacting positions.

A housing 2 is a substantially box-shaped body, and a frame member is provided inside the housing 2. A main body side plate 81 on the right side configuring the frame member is shown in FIG. 4 etc. A feeder unit 220, an image forming unit 10, a conveying unit 11, a fixing device 13, etc., are assembled with the frame member (refer to FIG. 1).

A discharge tray 14 is provided at the top surface side of the housing 2. Sheets on which image formation has been completed are discharged onto the discharge tray. In the housing 2, a substantially "S"-shaped route (indicated by the thick chain double-dashed line in FIG. 1) from the feeder unit 220 on the lower side up to the discharge tray 14 on the upper side via the image forming unit 10, the conveying unit 11, the fixing device 13, etc., is a conveying path P for sheets. A front cover 3 which is openable and closable with its lower end part as a swinging central axis is provided at the front surface of the housing 2.

2. Feeder Unit

The feeder unit 220 has a sheet feeding tray 221 housed so as to be removable with respect to the lower part of the housing 2, a sheet feeding roller 222 which is provided above the front end part of the sheet feeding tray 221, and which feeds sheets placed on the sheet feeding tray 221 to the conveying path P, and a separating pad 223 that applies predetermined conveying resistance to sheets to separate the sheets one by one to be fed by the sheet feeding roller 222.

Then, conveying rollers 224 and 225 that convey sheets toward the image forming unit 10, and registration rollers 226 and 227 that contact a leading end of a sheet to correct the sheet passing obliquely to further convey the sheet toward the image forming unit 10, are provided at a substantially U-shaped part on the downstream of the conveying path P.

3. Conveying Unit

The conveying unit 11 is disposed between the sheet feeding tray 221 and the image forming unit 10, and has a conveyor belt 11C, four transfer rollers 12, etc.

The conveyor belt 11C is wound around between a driving roller 11A located under the rear end side of the image forming unit 10 and a driven roller 11B located under the front end side of the image forming unit 10. Then, the driving roller 11A rotates in synchronization with the feeder unit 220, to cause the conveyor belt 11C to circulate between the driving roller 11A and the driven roller 11B. The upper side surface of the conveyor belt 11C is disposed in a substantially horizontal position directly under the image forming unit 10, and serves as a sheet conveying surface 11D that comes into contact with the back surface of a sheet to convey the sheet along the conveying path P.

The respective transfer rollers 12 are provided in the conveying unit 11 so as to come into contact with the conveyor belt 11C from the back surface side of the sheet conveying surface 11D. The conveyor belt 11C made of conductive rubber is negatively charged by applying transfer voltages to the respective transfer rollers 12, and the conveyor belt 11C conveys the sheets along the conveying path P while suctioning sheets with the sheet conveying surface 11D by an electrostatic force.

4. Image Forming Unit

The image forming unit 10 includes a scanner unit 9, four photosensitive drums 5 as an example of an image carrier, and four process cartridges 8 as an example of a developing unit, etc.

The scanner unit 9 is located on the uppermost side in the housing 2, and has a laser light source, a polygon mirror, an fθ lens, a reflecting mirror, etc. Then, a laser beam emitted from the laser light source is deflected by the polygon mirror to pass through the fθ lens, and thereafter its optical path is reflected by the reflecting mirror, and further, its optical path is inflected downward by the reflecting mirror, which causes the laser beam to irradiate the surfaces of the respective photosensitive drums 5 to form electrostatic latent images corresponding to the four colors of black, yellow, magenta, and cyan.

The respective photosensitive drums 5 and the respective process cartridges 8 correspond to the four colors of black, yellow, magenta, and cyan, and are installed in series from the upstream toward the downstream of the sheet conveying surface 11D under the scanner unit 9 and above the sheet conveying surface 11D. Such a configuration in which the respective photosensitive drums 5 and the respective process cartridges 8 are installed in series along the conveying path P for sheets in this way is called a "tandem type."

Each of the photosensitive drums 5 is configured such that a positively charged photosensitive layer is formed on the uppermost layer of a cylindrical body (a drum main body 47 shown in FIG. 2, etc.) made of resin. A charger 6 is installed in the vicinity of each of the photosensitive drums 5 to face the photosensitive layer of the photosensitive drum 5.

Each of the process cartridges 8 has a box-shaped development frame 51 whose posterior lower part is opened, a toner container 7A which is provided at an internal upper side of the development frame 51 and which contains toner, a supply roller 7B provided in the lower part of the development frame 51, a developing roller 7C which is exposed from the opening of the development frame 51 to face the photosensitive drum 5, etc. Then, the toner in the toner container 7A is supplied to the side of the developing roller 7C by rotation of the supply roller 7B, to be carried on the surface of the developing roller 7C, and adjusted to have a predetermined thickness by a layer thickness controlling blade 7D, and thereafter, the toner is supplied onto the surface of the photosensitive drum 5.

5. Fixing Device

The fixing device 13 is located on the downstream side from the image forming unit 10 in the conveying path P for sheets, and has a heating roller 13A installed on the side of the image forming surface of a sheet, and a pressure roller 13B which is installed on the side opposite to the heating roller 13A so as to pinch a sheet therebetween. The heating roller 13A rotates in synchronization with the conveyor belt 11C and the like, and imparts conveying force to the sheet while heating toner transferred to a sheet. On the other hand, the pressure roller 13B is driven to rotate while pressing the sheet to the side of the heating roller 13A. Thereby, the fixing device 13 heats to melt toner transferred to a sheet, to fix the toner on the sheet, and conveys the sheet to the downstream side of the conveying path P. Note that the conveying path P is curved into a substantially U-shape upward on the downstream side from the fixing device 13. Discharge rollers 228 and 229 and the discharge tray 14 are located on the most downstream side of the conveying path P.

6. Outline of Image Forming Operation

When an image forming operation is started in the printer 1, the feeder unit 220 and the conveying unit 11 are activated to convey a sheet to the image forming unit 10, and the scanner unit 9, the respective photosensitive drums 5 and process cartridges 8, etc., are activated. Then, the surfaces of the respective photosensitive drums 5 rotating are uniformly positively charged by the charger 6, and thereafter exposed to a laser beam caused to irradiate from the scanner unit 9, and electrostatic latent images corresponding to image forming data are formed on the surfaces of the respective photosensitive drums 5.

Meanwhile, toner which is carried on the developing rollers 7C and positively-charged are supplied onto the electrostatic latent images formed on the surfaces of the respective photosensitive drums 5 due to the developing rollers 7C rotating while facing and contacting the respective photosensitive drums 5. Thereby, the electrostatic latent images on the respective photosensitive drums 5 are made into visible images, and toner images due to reversal development are carried on the surfaces of the respective photosensitive drums 5.

Thereafter, the toner images carried on the surfaces of the respective photosensitive drums 5 are transferred to the sheet by transfer voltages applied to the respective transfer rollers 12. Then, when the sheet to which the toner images have been transferred is conveyed to the fixing device 13, the sheet is heated and pressurized by the heating roller 13A and the pressure roller 13B, and the toner images are fixed onto the sheet. Finally, the sheet on which the image has been formed is discharged onto the discharge tray 14, and the image forming operation is completed.

7. Drawer

As shown in FIG. 1, in the printer 1, in order to make the maintenance and the exchange of consumables easy, as will be described below in detail, the respective photosensitive drums 5 are held by a drawer 4, and the respective process cartridges 8 are held so as to be removable with respect to the drawer 4. The drawer 4 is drawn out from the inside of the housing 2 toward the front side or is inserted toward the back side in the housing 2 from the front side in a state in which the front cover 3 is open, to be loadable to and drawable from the apparatus main body of the printer 1. In detail, the loading position is a position at which the drawer 4 is capable of printing, and the drawer 4 is configured to be drawable to the outside of the housing 2 from that position, and to be movable between the loading position and the drawn position. By drawing the drawer out, it is possible to exchange the process cartridges 8. Here, the apparatus main body includes the above-described components (the housing 2, the frame member, the feeder unit 220, the scanner unit 9, the conveying unit 11, the fixing device 13, etc.) of the printer 1 other than the respective photosensitive drums 5, the respective process cartridges 8, and the drawer 4. Further, the drawer 4 is removable from the apparatus main body in a state of being drawn out to the outside of the housing 2. The drawer 4 may not be removable from the apparatus main body in a state of being drawn out to the outside of the housing 2.

Figure 2:
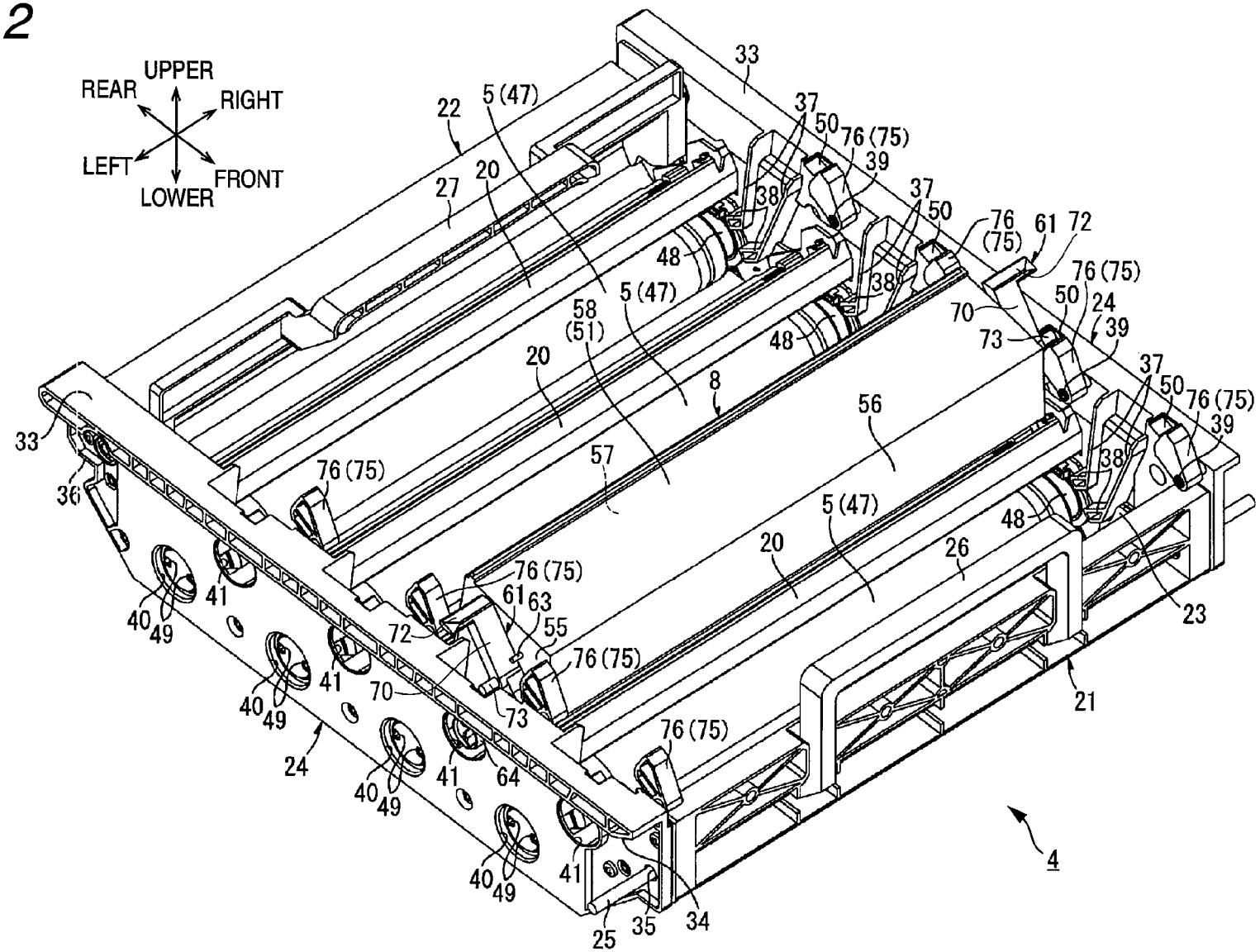
FIG. 2 is a perspective view of the image forming apparatus according to the first illustrative embodiment, in a state where a developing unit is loaded into a drawer.
Figure 3:
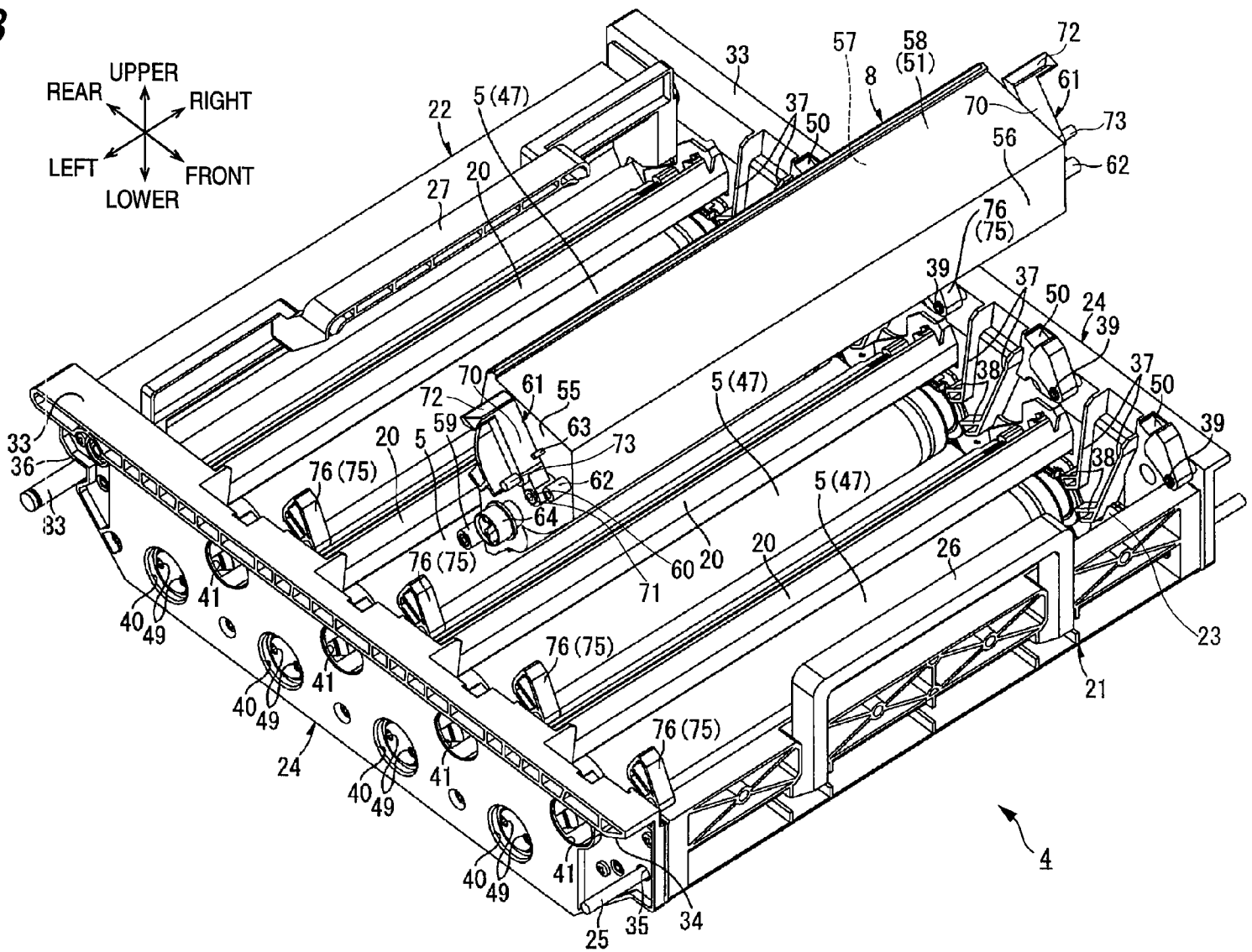
FIG. 3 is a perspective view of the image forming apparatus according to the first illustrative embodiment, in a state where the developing unit is removed from the drawer.

As shown in FIGS. 2 and 3, the drawer 4 as a single body is configured such that a front beam 21 on the front side, a rear beam 22 on the rear side, four intermediate beams 20 arrayed in a front-to-rear direction between the front beam 21 and the rear beam 22, a pair of first side plates 23 (shown in FIG. 4) which extend in the front-to-rear direction and face each other in its width direction (a direction which is the same as the right-to-left direction shown in the respective drawings), and a pair of second side plates 24 which are provided along the outer sides in the width direction of the respective first side plates 23 are integrally assembled.

The front beam 21 is made of resin in the present illustrative embodiment, and is provided to bridge between the front end parts of the pair of first side plates 23. The front beam 21 holds the supporting shaft 25. The supporting shaft 25 is disposed so as to pass through the front beam 21 along the width direction, to project outward in the width direction from the front beam 21. The supporting shaft 25 further passes through supporting shaft insertion holes 30 (shown in FIG. 4) of the first side plates 23 and supporting shaft insertion holes 35 of the second side plates 24, to project outward in the width direction. A front side gripper 26 projecting upward is provided in the center in the width direction of the front beam 21.

The rear beam 22 is made of resin in the present illustrative embodiment, and is provided to bridge between the rear end parts of the pair of first side plates 23. A back side gripper 27 projecting obliquely upward from the rear side is provided in the center in the width direction of the rear beam 22. The front side gripper 26 and the back side gripper 27 are gripped by a user at the time of loading and removing the drawer 4.

The four intermediate beams 20 are made of resin in the present illustrative embodiment, and are provided to bridge with distances in the front-to-rear direction between the pair of first side plates 23. Each of the intermediate beams 20 is formed into a substantially triangular pole shape which is elongated in the width direction, and whose anterior lower side is opened. The charger 6 (shown in FIG. 1) and a cleaning member (not shown) for cleaning up the surface of the photosensitive drum 5 are held on each of the intermediate beams 20.

As the left side surface of the first side plate 23 on the right side is shown in FIG. 4, the right and left first side plates 23 are manufactured into the same shape by press working for metal plates by use of a same press mold in the present illustrative embodiment. The first side plate 23 is formed into a substantially elongated rectangular plate shape extending in the front-to-rear direction. Although not shown in the drawing, the front end parts and the rear end parts of the respective first side plates 23, respectively, face each other so as to sandwich the front beam 21 and the rear beam 22 in the width direction from the outside.

An inclining portion which extends posteriorly upward and a straight portion which extends substantially upward from a rear end part of the inclining portion are provided to the rear end part of the first side plate 23. Additionally, a notched part 31 that is notched into a substantially V-shape is formed in the boundary of the inclining portion and the straight portion. Four circular drum supporting holes 32 arrayed in the front-to-rear direction are formed in the first side plate 23.

As shown in FIGS. 2 and 3, the second side plate 24 in the present illustrative embodiment is made of fiber-reinforced resin and is provided to both the right and left sides to form a pair. The second side plate 24 is formed into a substantially elongated rectangular plate shape in side view, which is vertically wider and has approximately the same length in the front-to-rear direction as compared with the first side plate 23 (refer to FIG. 4). The front end parts and the rear end parts of the second side plates 24 respectively face each other so as to sandwich the front beam 21 and the rear beam 22 via the first side plates 23 in the width direction from the outside.

A guard part 33 extending outward in the width direction is formed over the front-to-rear direction on an upper end part of the second side plate 24. An inclined surface 34 inclined anteriorly upward from the bottom surface is formed in the front end part of the guard part 33.

The rear end part of the second side plate 24 under the guard part 33 is formed to be vertically narrower in width than the front part of the second side plate 24. Specifically, a lower end part of the second side plate 24 is inclined posteriorly upward. A notched part 36 having substantially the same shape as the notched part 31 is formed at a position facing the notched part 31 of the first side plate 23 (refer to FIG. 4) in the width direction in the rear end part of the second side plate 24.

The second side plate 24 on the right side viewed from the left side is shown in FIG. 4. Four cartridge guiding parts 37, for guiding the process cartridges 8 to be removable (refer to FIGS. 2 and 3) in respect to the right and left second side plates 24, are formed to the surfaces of the second side plates facing inward in the width direction. The four cartridge guiding parts 37 are formed with an even distance from each other in the front-to-rear direction. The cartridge guiding part 37 is formed of two protrusions which project inward in the width direction from the internal surface of the second side plate 24 and are formed with a distance from each other. The cartridge guiding part 37 is inclined posteriorly downward at a constant angle from the upper end part of the second side plate 24, to be coupled with a cartridge holding part 38. The cartridge holding part 38 is formed in parallel with a straight line H (shown in FIG. 1) connecting the center of the photosensitive drum 5 and the center of the developing roller 7C, and its lower end part is opened to the photosensitive drum 5.

Figure 5:
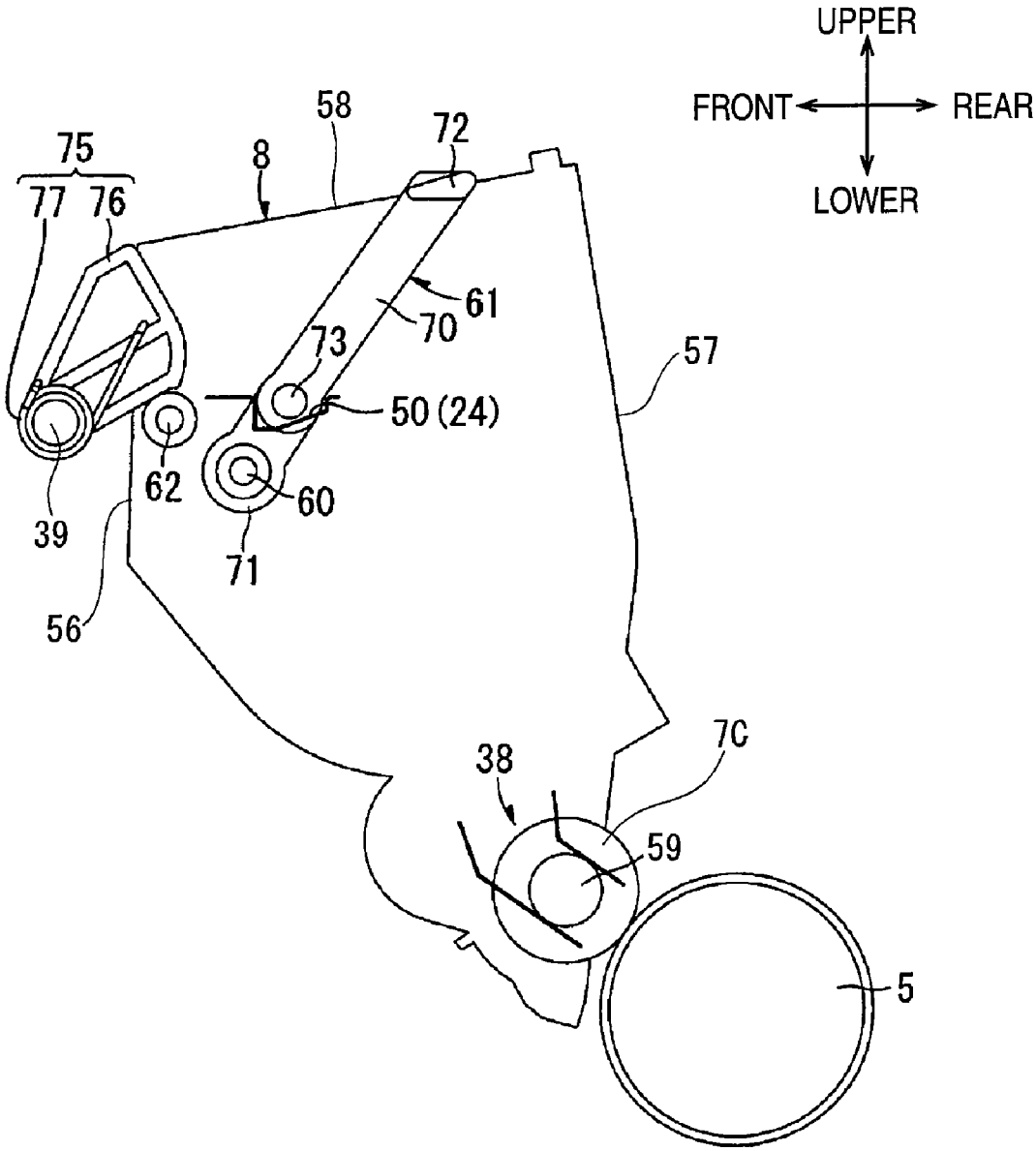
FIG. 5 is a schematic side view of the image forming apparatus according to the first illustrative embodiment, and shows a relative positional relationship of the developing unit, an image carrier, and a contacting and spacing mechanism in a state where the developing unit is at the contacting position.

As shown in FIGS. 3 and 4, four second supporting shafts 39 that swingably support pressing cams 76 which will be described later, are provided to project on the upper end part of the internal surface of the second side plate 24. The four second supporting shafts 39 are provided to project with an even distance from each other in the front-to-rear direction. Further, as shown in FIG. 3, four contact grooves 50 are formed with an even distance from each other in the front-to-rear direction in the upper end part of the internal surface of the second side plate 24. FIG. 5 shows a relative positional relationship of the second supporting shaft 39, the contact groove 50, and the cartridge holding part 38 in the case in which the process cartridge 8 loaded into the drawer 4 is viewed in the width direction.

As shown in FIGS. 2 and 3, four drum coupling insertion holes 40 through which the axial left end parts of the respective photosensitive drums 5 are exposed are formed in the second side plate 24 on the left side. The four drum coupling insertion holes 40 are formed in line with an even distance from each other in the front-to-rear direction. The drum coupling insertion holes 40 are formed as circular holes passing through the second side plate 24 in the thickness direction at positions facing the axial left end parts of the respective photosensitive drums 5 and the drum supporting holes 32 provided in the first side plate 23 on the right side in the width direction. Cartridge guiding parts 37 are also formed to the second side plate 24 on the left side at positions facing the respective cartridge guiding parts 37 formed on the second side plate 24 on the right side. Further, development coupling insertion holes 41 are respectively formed in the vertically middle portions of the respective cartridge guiding parts 37 in the second side plate 24 on the left side. As shown in FIG. 2, in the state in which the respective process cartridges 8 are loaded between the right and left second side plates 24, development couplings 64 provided at the left side surfaces of the process cartridges 8 face the respective development coupling insertion holes 41.

Although not shown in the drawings, a plurality of electrodes is provided at the second side plate 24 on the right side. The electrodes contact a plurality of spring shaped electrodes projecting from the internal surface in the width direction of the main body side plate 81 on the right side toward the second side plate 24 on the right side which faces the main body side plate 81, in a state in which the drawer 4 is loaded in the apparatus main body, to electrically connect a power source provided in the apparatus main body, the process cartridges 8, the chargers 6, etc.

As shown in FIGS. 2 and 3, the photosensitive drum 5 has two flange members 48 respectively fitted into the both end parts of the cylindrical drum main body 47 so as to be incapable of relatively rotating. The right and left flange members 48, respectively, are supported rotatably with respect to the drum supporting holes 32 (refer to FIG. 4) in the right and left first side plates 23 with bearing members (not shown). Further, a coupling groove 49 (refer to FIG. 4) which is coupled with a driving transmission unit (not shown) provided in the housing 2 to allow the photosensitive drum 5 to rotate is provided in the left end surface of the flange member 48 on the left side.

As shown in FIGS. 3 and 5, the development frame 51 has a pair of right and left side walls 55, a front wall 56, a rear wall 57, and an upper wall 58 that join the pair of side walls 55. The axial both end parts of a roller shaft 59 of the developing roller 7C pass through the lower end parts of the side walls 55 to project outward in the width direction.

Supporting shafts 60 are provided at positions on the anterior upper sides in the respective side walls 55. The supporting shaft 60 is provided to project outward in the width direction from the side wall 55. A moving member 61 is supported swingably by the supporting shaft 60. A columnar development pressing boss 62 is provided to project outward in the width direction from the side wall 55 at a position anteriorly above the supporting shaft 60. Moreover, a spring (not shown) is provided around the supporting shaft 60, and the moving member 61 is biased in the counterclockwise direction in FIG. 5 by the biasing force of the spring.

As shown in FIG. 3, a regulatory boss 63 for regulating the swinging range of the moving member 61 is provided to project outward in the width direction from the side wall 55 above the supporting shaft 60. The development coupling 64 is disposed at the position anteriorly above the roller shaft 59 in the side wall 55 on the left side. The development coupling 64 is connected to a plurality of gears (not shown) for transmitting rotary driving force to the developing roller 7C and the supply roller 7B (refer to FIG. 1).

As shown in FIGS. 3 and 5, the moving members 61 are provided as a pair on the both sides of the process cartridge 8 in the width direction, and the moving member 61 has a main body part 70 extending in a direction perpendicular to a shaft direction of the supporting shaft 60. One end part of the main body part 70 forms an acting part 71 supported rotatably by the supporting shaft 60. The other end part of the main body part 70 is folded outward in the width direction, to further project outward in the width direction, and the projected portion serves as an input part 72. A columnar boss 73 projecting outward in the width direction is formed on the middle portion of the main body part 70.

8. Contacting Mechanism

As shown in FIGS. 3 to 5, contacting mechanisms 75 acting on the respective development pressing bosses 62 in a state in which the process cartridges 8 are in a course of being loaded or are loaded in the drawer 4, are provided at the respective second side plates 24 of the drawer 4. The contacting mechanisms 75 are provided with four pressing cams 76 and four pressing springs 77 (shown in FIG. 5) that elastically press the respective pressing cams 76 against the respective development pressing bosses 62.

As shown in FIG. 5, the pressing cam 76 has a substantially triangular plate shape in side view. The second supporting shaft 39 which projects inward in the width direction of the second side plate 24 is inserted through one corner part of the pressing cam 76, and the pressing cam 76 is supported swingably by the second supporting shaft 39. The pressing cam 76 is provided in position extending posteriorly and obliquely upward from the one corner part supported by the second supporting shaft 39. The pressing spring 77 is wound around the second supporting shaft 39, and one end part thereof is locked on the guard part 33 of the second side plate 24, and the other end part thereof is locked on the pressing cam 76. Thereby, the leading end part of the pressing cam 76 is, biased posteriorly downward, and the pressing cam 76 comes into contact with the development pressing boss 62 from anteriorly above, to bias the development pressing boss 62 downward in a state in which the process cartridges 8 are loaded into the drawer 4.

9. Loading Operation of the Development Cartridge into the Drawer

The process cartridges 8 of the respective colors are loaded between the right and left second side plates 24 from above as shown in FIG. 3. At this time, the both end parts of the roller shaft 59 projecting from the both side walls 55 of the development frame 51 of the process cartridge 8 are introduced into the cartridge guiding parts 37 from above. Then, the both end parts of the roller shaft 59 are guided to the cartridge guiding parts 37, to move the process cartridge 8 downward.

Then, as shown in FIG. 5, when the process cartridge 8 is guided to the cartridge holding parts 38, and the developing roller 7C contacts the photosensitive drum 5, further pressing of the process cartridge 8 is regulated, that performs positioning of the developing roller 7C with respect to the photosensitive drum 5. At this time, the development pressing boss 62 of the process cartridge 8 passes between the pressing cam 76 and the acting part 71 of the moving member 61 to get under the pressing cam 76 when viewed from the width direction (i.e., the direction from the front side of the sheet plane to the back side of the sheet plane). Thus, the development pressing boss 62 is biased downward by the pressing spring 77 and the pressing cam 76, and as a result, the process cartridge 8 is pressed downward, which causes the developing roller 7C to contact the photosensitive drum, 5 and further, press the photosensitive drum 5. In this state, the boss 73 of the moving member 61 gets into the contact groove 50 of the second side plate 24 (shown in FIG. 2), to be disposed at a position with a slight distance from the bottom surface of the contact groove 50.

The position of the process cartridge 8 shown in FIG. 5, i.e., a position at which the developing roller 7C presses the photosensitive drum 5, is a "contacting position." As described above, in the present illustrative embodiment, the developing roller 7C is configured to press the photosensitive drum 5 at the "contacting position. Meanwhile, the developing roller 7C may be configured to merely contact the photosensitive drum 5 at the "contacting position". Further, the "contacting position" is the position of the developing roller 7C with respect to the photosensitive drum 5 for allowing the drawer 4 to be removed from the apparatus main body, that is, the "drawn position" as well. Meanwhile, as will be described later, the position of the process cartridge 8 shown in FIG. 12, i.e., a position at which the developing roller 7C is spaced from the photosensitive drum 5, is the "spacing position."

As shown in FIG. 2, when the respective process cartridges 8 are loaded in the drawer 4, the respective development couplings 64 face the respective development coupling insertion holes 41. Then, when the drawer 4 in which process cartridges are loaded is loaded into the housing 2 and the drawer 4 reaches the loading position, the driving transmission units (not shown) for transmitting driving force from a motor (not shown) provided in the housing 2 (refer to FIG. 1) are inserted through the respective development coupling insertion holes 41. The respective driving transmission units are coupled with the respective development couplings 64 to transmit rotary driving force to the developing rollers 7C and the supply rollers 7B (refer to FIG. 1) via the respective driving transmission units and the respective development couplings 64.

10. Positioning Structure and Loading Operation at the Time of Loading the Drawer into the Apparatus Main Body As shown in FIG. 4, the pair of main body side plates 81 facing each other with a distance in the width direction (only the main body side plate 81 on the right side is shown) are provided in the housing 2. Roller members 82 that come into contact with the guard parts 33 of the respective second side plates 24 from underneath to guide the drawer 4 slidably along the inside of the housing 2, are supported rotatably by the front end parts of the main body side plates 81. Further, one main body reference shaft 83 is provided to bridge between the rear end parts of the right and left main body side plates 81.

At the time of loading the drawer 4 into the apparatus main body, first, in a state in which the front cover 3 (refer to FIG. 1) is open, the rear end edges of the guard parts 33 of the second side plates 24 are brought into contact with the roller members 82 from above. Thereafter, when the drawer 4 is inserted toward the back side in the housing 2, the guard parts 33 slide on the roller members 82, and the drawer 4 is guided up to the back in the housing 2. At this time, the respective input parts 72 move above respective cam parts 96 of translation cams 92 which will be described later. Then, when the roller members 82 come into contact with the inclined surfaces 34 (refer to FIG. 2 and the like) provided at the front sides of the guard parts 33, the drawer 4 moves totally downward, and thereafter, the notched parts 31 of the first side plates 23 come into contact with the main body reference shaft 83 from above and from the front side. Then, the both end parts of the supporting shaft 25 push groove parts 130 provided in the front edges of the main body side plates 81 backward and downward, which regulates further pressing of the drawer 4. At this time, the respective input parts 72 move downward to come between the respective cam parts 96 which will be described later. In this way, the loading operation of the drawer 4 into the apparatus main body is completed.

An operation of removing the drawer 4 from the apparatus main body is opposite to the loading operation described above. Here, even in the process of removing the drawer 4 from the apparatus main body, the contacting mechanism 75 holds the process cartridge 8 at the drawn position (contacting position) by the biasing force of the pressing springs 77. Therefore, it is possible to reduce the vertical height of the opening portion in the housing 2 through which the drawer 4 passes, which realizes reducing the size of the apparatus. Further, even after the drawer 4 is removed from the apparatus main body by drawing the drawer 4 out of the housing 2, the contacting mechanism 75 holds the process cartridge 8 at the drawn position by the biasing force of the pressing springs 77. Therefore, backlash is hardly caused in the process cartridge 8, and even if a user turns over the drawer 4, unintended dropping of the process cartridge 8 may be prevented.

11. Spacing Mechanism

As shown in FIG. 4, a spacing mechanism 91 is provided on the upper side of the main body side plate 81 in the housing 2. The spacing mechanism 91 operates in cooperation with the contacting mechanism 75 in a state in which the drawer 4 is loaded into the apparatus main body, to move the respective process cartridges 8 to the "contacting position" (the position shown in FIG. 5) which is the position at which the respective process cartridges 8 contact the respective photosensitive drums 5 and the "spacing position" (the position shown in FIG. 12) which is the position at which the respective process cartridges 8 are spaced from the respective photosensitive drums 5.

The spacing mechanism 91 has a pair of rails 93, a pair of translation cams 92 held by the pair of rails 93 so as to be able to move straightly in the front-to-rear direction, and a synchronous moving mechanism 94 for synchronously moving the respective translation cams 92 straightly.

The respective rails 93 (only the right side rail 93 is shown) are fixed to the main body side plates 81 on both the right and left sides in the housing 2, and the rail 93 has a main body part 99 in a substantially rectangular shape in side view, which extends in the front-to-rear direction, a first guard part 100 extending inward in the width direction from the upper end edge of the main body part 99, and a second guard part 101 extending inward in the width direction from the lower end edge of the main body part 99. A stopper part 102 extending upward further from the inner end edge in the width direction is formed on the second guard part 101. Four concave parts 103 in a shape notched from the upper end are formed in the middle portion in the front-to-rear direction of the stopper part 102.

A notched part 104 notched into a rectangular shape in side view from the top surface is formed in the rear end part of the main body part 99 and the first guard part 100. The translation cam 92 is disposed on the second guard part 101 in a state which the cam parts 96 project inward in the width direction. The translation cam 92 is provided slidably along the rail 93, and the rear end part of the translation cam 92 is always exposed upward from the notched part 104 regardless of the position of the translation cam 92.

Figure 6:
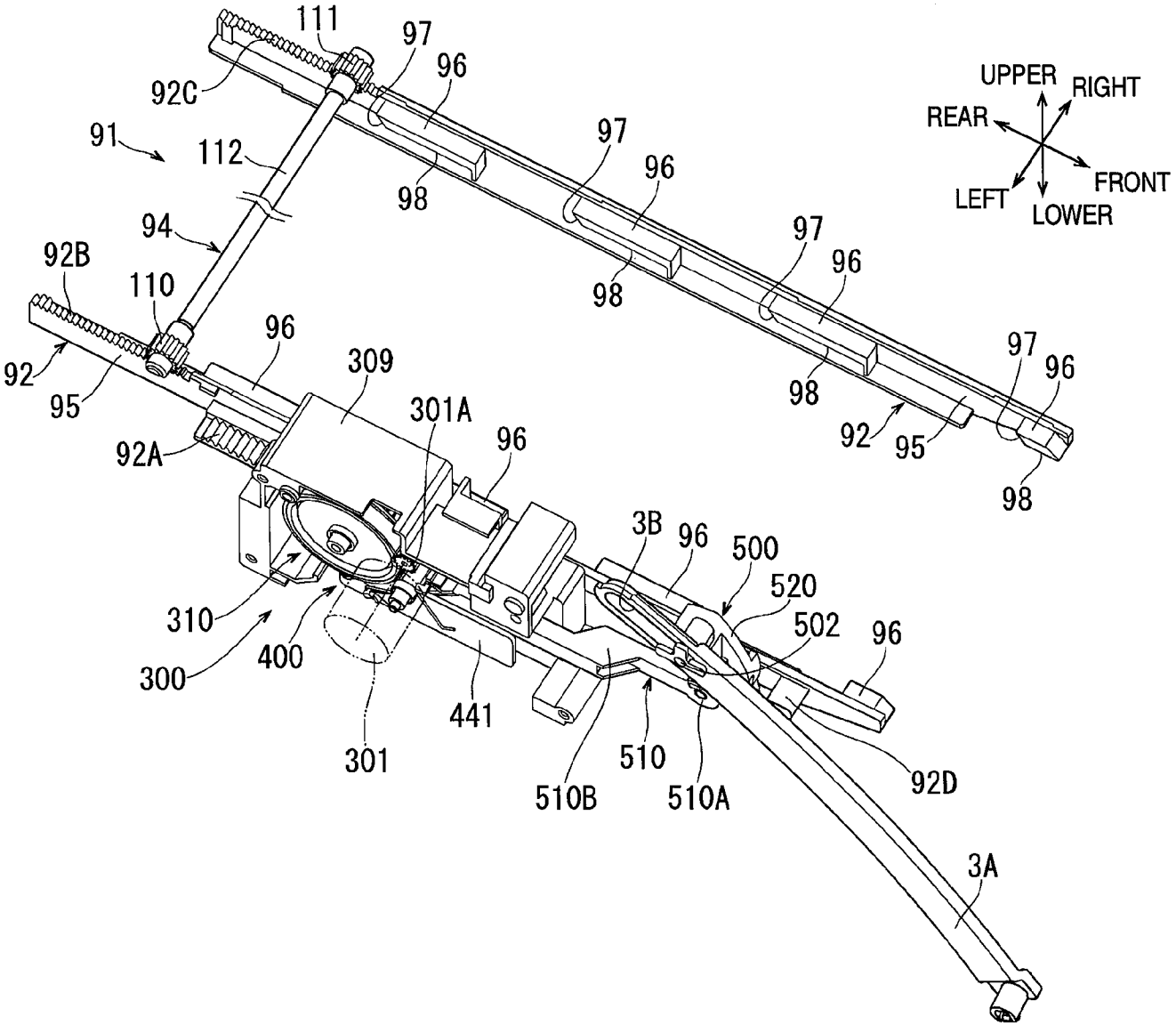
FIG. 6 is a perspective view of the image forming apparatus according to the first illustrative embodiment, and shows a spacing mechanism, a driving unit, an arm, a first acting part, and a second acting part.
Figure 7:
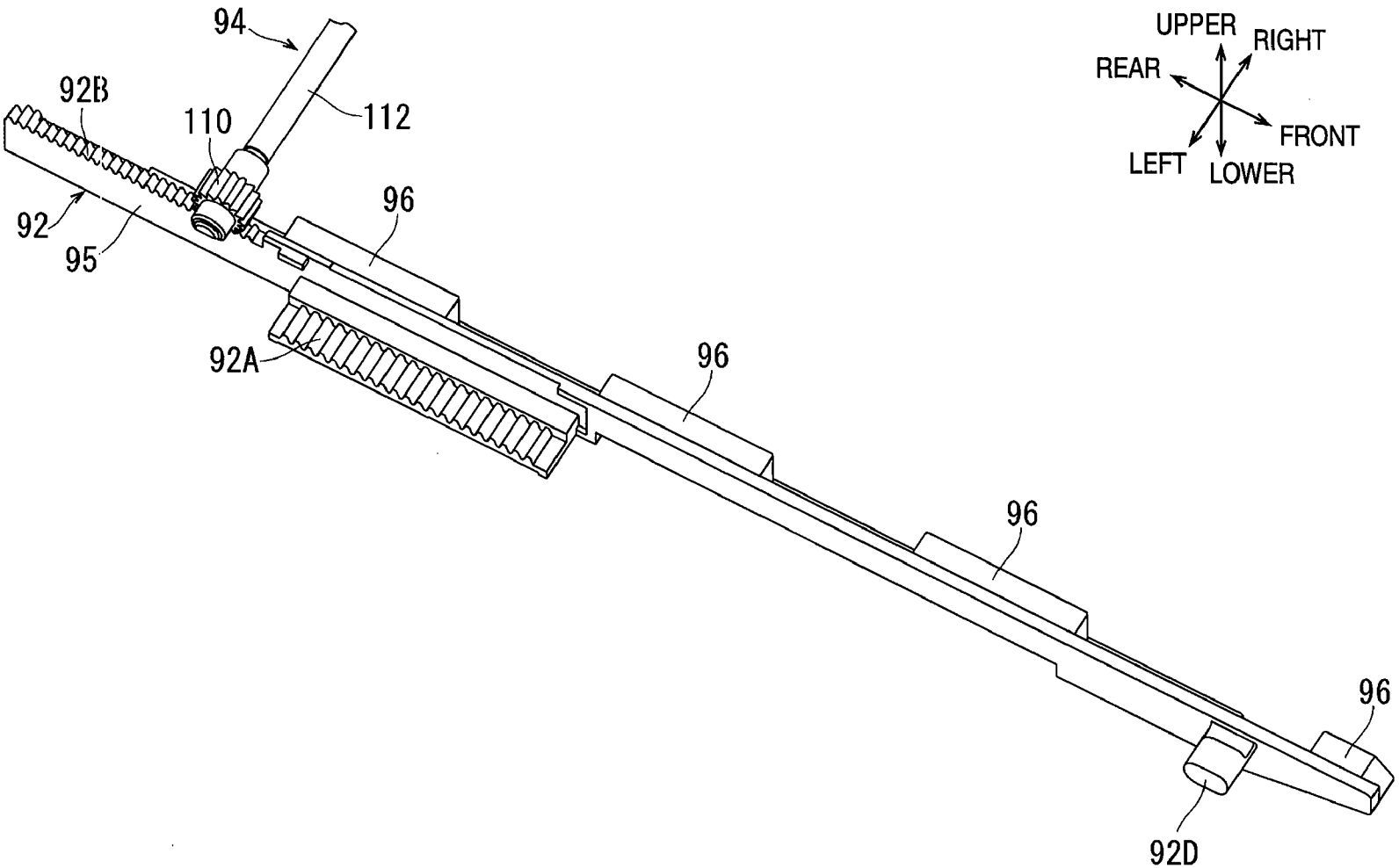
FIG. 7 is a perspective view of the image forming apparatus according to the first illustrative embodiment, and shows a translation cam on the left side.

As shown in FIG. 6, the right and left translation cams 92 basically have same shapes symmetrically with respect to a line. However, as shown in FIG. 7, an input rack gear part 92A extending in the front-to-rear direction is integrally formed with substantially the center of the left side surface of the translation cam 92 on the left side. Further, a pillar-shaped pressed part 92D projecting outward in the width direction is integrally formed with the front end part of the left side surface of the translation cam 92 on the left side. When the arm 500 is displaced from the position shown in FIG. 9 to the position shown in FIG. 15, as will be described later, the pressed part 92D contacts the second acting part 520, to be pushed forward.

As shown in FIGS. 6 and 7, the translation cam 92 is integrally provided with a main body part 95 in a substantially elongated rectangular shape in side view, which extends in the front-to-rear direction, and the four cam parts 96 arrayed in the front-to-rear direction on the internal surface of the main body part 95. The respective cam parts 96 are provided so as to correspond to the respective input parts 72 projecting on the upper side of the process cartridges 8 of the respective colors. A first inclined surface 97 inclined anteriorly downward from the upper end edge is formed in the rear end part of the cam part 96. Further, a second inclined surface 98 horizontally extending forward is formed on the bottom surface side of the cam part 96 continuously from the first inclined surface 97. Although not shown in the drawing, the second inclined surface 98 is slightly inclined inward in the width direction and upward from the side of the main body part 95.

The three cam parts on the rear side (the three cam parts 96 other than the frontmost cam part 96) are formed so as to have an even distance between mutually adjacent cam parts 96. On the other hand, the frontmost cam part 96 is formed so as to have a distance from the cam part 96 adjacent thereto greater than the even distance between the three cam parts 96 on the rear side.

As shown in FIG. 6, the synchronous moving mechanism 94 is provided with a left rack gear part 92B formed on the top surface in the rear end part of the translation cam 92 on the left side, a left pinion gear 110 meshing with the left rack gear part 92B, a right rack gear part 92C formed on the top surface in the rear end part of the translation cam 92 on the right side, a right pinion gear 111 meshing with the right rack gear part 92C, and a coupling shaft 112 that couples the left pinion gear 110 and the right pinion gear 111 so as to be incapable of relatively rotating.

12. Driving Unit

Figure 8:
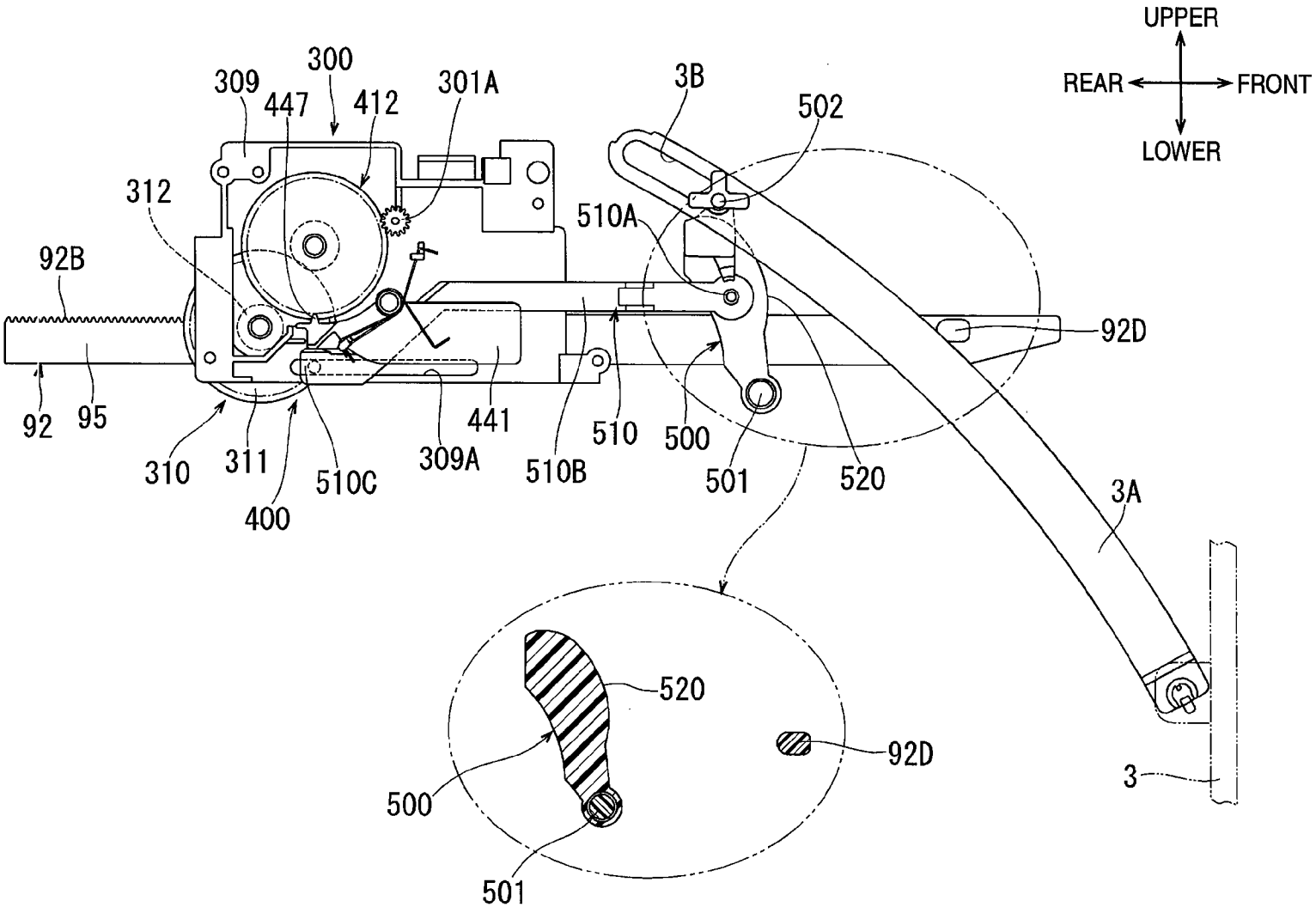
FIG. 8 is a side view of the image forming apparatus according to the first illustrative embodiment, and shows the translation cam, the driving unit, the arm, the first acting part, and the second acting part, wherein the translation cam is at the frontmost position and the arm is at the first position.
Figure 9:
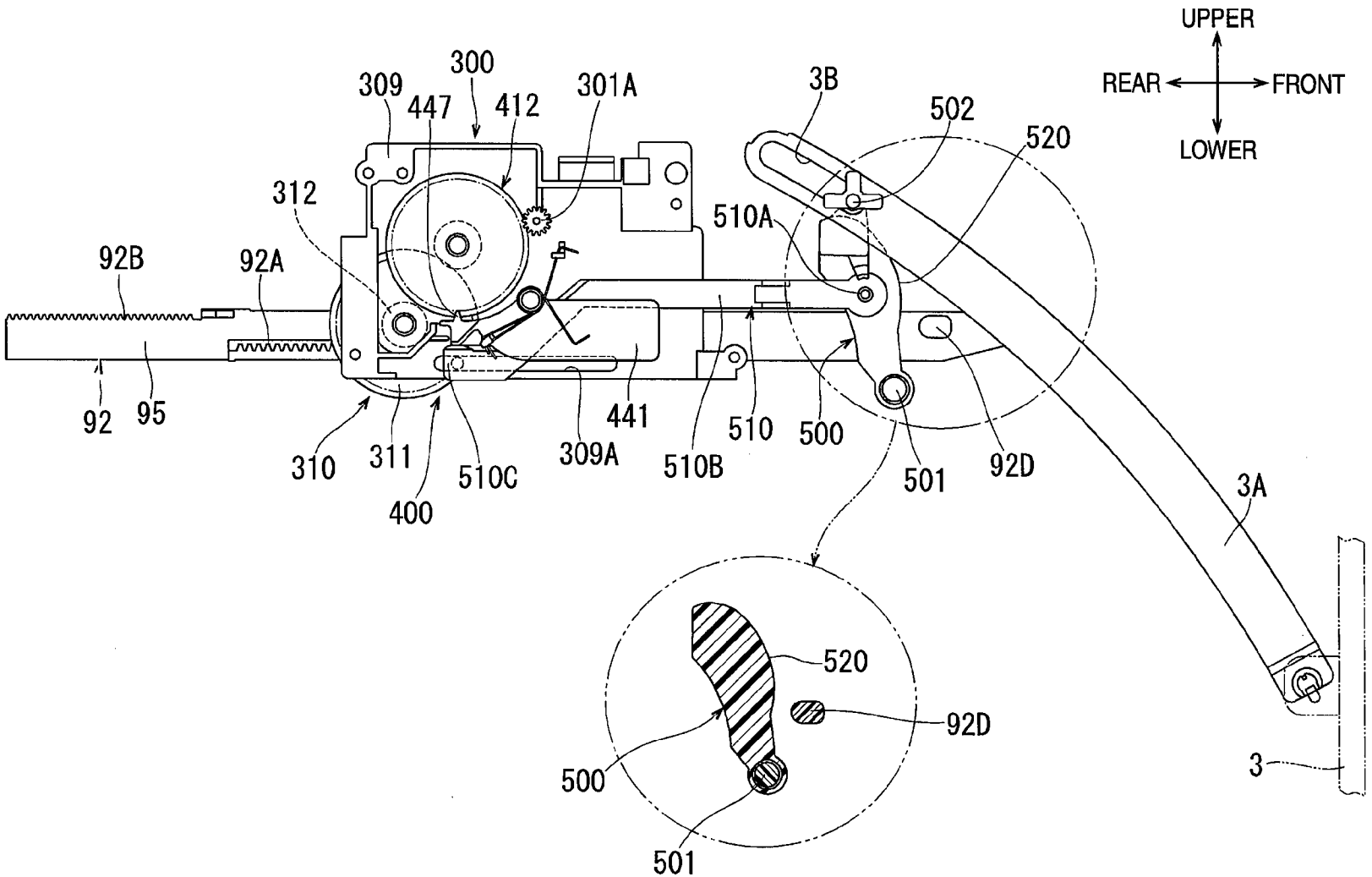
FIG. 9 is a side view of the image forming apparatus according to the first illustrative embodiment, and shows the translation cam, the driving unit, the arm, the first acting part, and the second acting part, wherein the translation cam is at the rearmost position and the arm is at the first position.

As shown in FIGS. 6, 8, and 9, driving unit 300 for driving the spacing mechanism 91 is provided between the left outer wall (not shown) of the housing 2 and the main body side plate on the left side (not shown). The state shown in FIG. 8 shows a state in which the translation cam 92 is driven by the driving unit 300 to move to the frontmost position. On the other hand, the state shown in FIG. 9 shows a state in which the translation cam 92 is driven by the driving unit 300 to move to the rearmost position.

The driving unit 300 has an electric motor 301, a driving transmission unit 310 that transmits driving force of the electric motor 301 to the input rack gear part 92A, and a clutch mechanism 400. The electric motor 301, the driving transmission unit 310, and the clutch mechanism 400 are held by a holder member 309. The clutch mechanism 400 has a displacement member 441 and a planetary differential clutch 412 as an example of a differential gear of the present invention.

The displacement member 441 is a plate-shaped body made of resin, which extends in the front-to-rear direction, and its upper intermediate part is supported swingably by a supporting shaft formed in the holder member 309. A locking claw 447 projecting toward the upper planetary differential clutch 412 is formed in the rear end part of the displacement member 441. The locking claw 447 is biased downward by a biasing spring installed between the holder member 309 and the displacement member 441. However, in a state in which an image forming operation is possible, i.e., in a state in which the drawer 4 is loaded into the apparatus main body and the front cover 3 is closed, a rear end part 510C of the first acting part 510 which will be described later comes into contact with the rear end part of the displacement member 441 from underneath, to regulate the downward displacement of the locking claw 447, which brings a state in which the locking claw 447 engages with a fixing gear 436 which will be described later.

Figure 10:
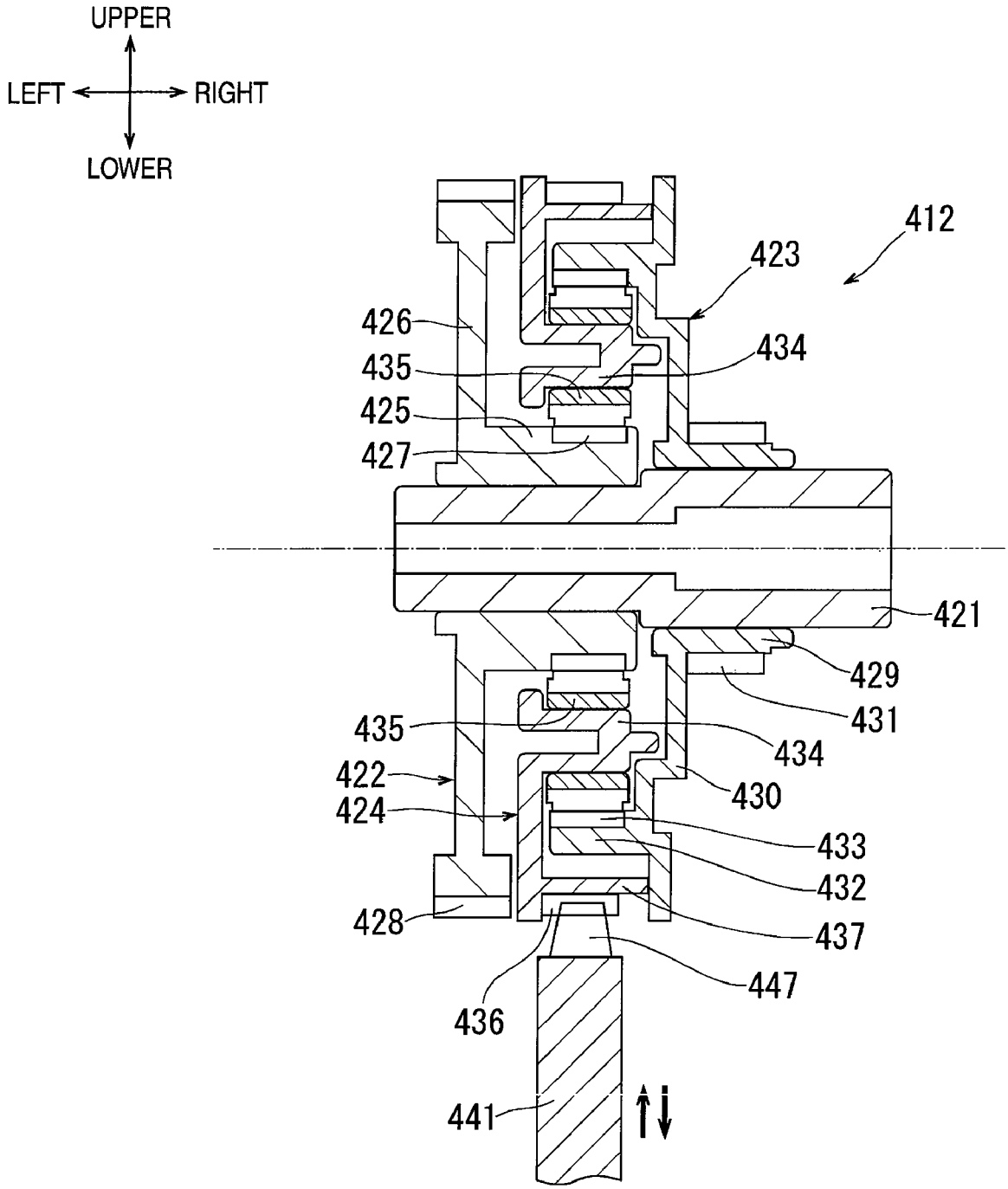
FIG. 10 is a main portion enlarged cross-sectional view of the image forming apparatus according to the first illustrative embodiment, and shows a driving transmission unit and a clutch mechanism.

The planetary differential clutch 412 is installed in the driving transmission unit 310 at a position in the middle of the route for transmitting driving force of the electric motor 301 to the input rack gear part 92A. The planetary differential clutch 412 configures the driving transmission unit 310 along with a large gear 311 and a small gear 312 which is integrally formed with the large gear 311 and which meshes with the input rack gear part 92A. As shown in FIG. 10 (the front side of the sheet plane is the apparatus front surface side in FIG. 10), the planetary differential clutch 412 has a two-stage cylindrical gear supporting shaft 421 extending outward in the width direction from the holder member 309. A driving input gear 422, a driving output gear 423, and a planetary gear base member 424 are supported rotatably by the gear supporting shaft 421.

The driving input gear 422 is supported rotatably by a left end part of the gear supporting shaft 421. The driving input gear 422 integrally has a cylindrical gear boss part 425 which is fitted into the outside of the gear supporting shaft 421, and a flange type overhanging part 426 overhanging circumferentially from a right end part of the gear boss part 425. A sun gear part 427 meshing with respective planetary gears 435 which will be described later is formed on an outer circumferential surface of the right end part of the gear boss part 425.

The peripheral part of the overhanging part 426 has a thickness in its right-to-left direction, and an input gear part 428 with which a pinion gear 301A of the electric motor 301 meshes is formed on an outer circumferential surface of the overhanging part 426.

The driving output gear 423 is supported rotatably by a right end part of the gear supporting shaft 421, and is disposed with a distance in its right-to-left direction from the driving input gear 422. The driving output gear 423 integrally has a cylindrical gear boss part 429 which is fitted into the outside of the gear supporting shaft 421, and a flange type overhanging part 430 overhanging circumferentially from a left end part of the gear boss part 429. An output gear part 431 meshing with the large gear 311 (shown in FIGS. 8 and 9) is formed on the outer circumferential surface of the left end part of the gear boss part 429. A cylinder part 432 projecting from a middle portion in the radial direction toward the driving input gear 422 is formed on the left side surface of the overhanging part 426. The cylinder part 432 is formed into a cylindrical shape surrounding the periphery centering on the gear supporting shaft 421, and faces the sun gear part 427 of the driving input gear 422. An internal gear part 433 meshing with the respective planetary gears 435 which will be described later is formed on an inner circumferential surface of the cylinder part 432 (the surface opposite to the sun gear part 427).

The planetary gear base member 424 is disposed between the driving input gear 422 and the driving output gear 423, and is provided rotatably around the gear supporting shaft 421. The planetary gear base member 424 is formed in a perforated disk shape in side view. A plurality of planetary gear supporting parts 434 projecting to the right side (the side of the driving output gear 423) are integrally formed on the circumference centering on the gear supporting shaft 421 in the planetary gear base member 424. The planetary gears 435 are supported rotatably (to be capable of spinning) by the respective planetary gear supporting parts 434, and the respective planetary gears 435 mesh with the sun gear part 427 of the driving input gear 422 and the internal gear part 433 of the driving output gear.

Further, a cylindrical gear forming part 437 centering on the gear supporting shaft 421 is formed so as to project to the right side in the peripheral part of the planetary gear base member 424. The fixing gear 436 with which the locking claw 447 of the displacement member 441 is capable of meshing is formed on the outer circumferential surface of the gear forming part 437, which will be described later.

In a state in which an image forming operation is possible, i.e., in a state in which the drawer 4 is loaded into the apparatus main body and the front cover 3 is closed, the locking claw 447 of the displacement member 441 engages with the fixing gear 436 of the planetary gear base member 424, to prohibit the planetary gear base member 424 from rotating. Therefore, when a torque is input to the input gear part 428 of the driving input gear 422 from the intermediate gear 409, to cause the driving input gear 422 to rotate, the respective planetary gears 435 spin without changing their positions circumferentially centering on the gear supporting shaft 421, and due to the spinning of the respective planetary gears 435, the driving output gear 423 having the internal gear part 433 meshing with the planetary gears 435 rotates around the gear supporting shaft 421. Then, the torque of the driving output gear 423 is transmitted to the large gear 311 (refer to FIG. 8), and the small gear 312 (refer to FIG. 8) also rotates according to the large gear 311. In this way, the driving force of the electric motor 301 is transmitted to the input rack gear part 92A, and the translation cam 92 integrally formed with the input rack gear part 92A straightly moves forward or backward.

On the other hand, as will be described later, at the time of removing the drawer 4 from the apparatus main body, the locking claw 447 of the displacement part 441 is spaced from the fixing gear 436 of the planetary gear base member 424 while interlocking with the opening of the front cover 3, to allow the planetary gear base member 424 to rotate. Therefore, even if a torque is input to the input gear part 428 of the driving input gear 422 from the intermediate gear 409, the respective planetary gears 435 revolve (the planetary gear base member 424 rotates around the gear supporting shaft 421) while spinning around the gear supporting shaft 421 according to the rotation of the driving input gear 422, and thus the driving output gear 423 does not rotate. In contrast, even if the driving output gear 423 is rotated in a state in which the driving input gear 422 is stopped (a state in which breaking force is exerted to the driving input gear 422 due to the electric motor 301 stopping), when the displacement member 441 is spaced from the planetary gear base member 424, the respective planetary gears 435 revolve (the planetary gear base member 424 rotates around the gear supporting shaft 421) while spinning around the gear supporting shaft 421 according to the rotation. In this way, in a state in which the locking claw 447 is spaced from the fixing gear 436, the driving input gear 422 and the driving output gear 423 are out of relationship, and the transmission of driving force from the electric motor 301 to the large gear 311 is blocked. As a result, the transmission of driving force from the electric motor 301 to the input rack gear part 92A is discontinued.

By adopting the above-described clutch mechanism 400 which is easy to downsize, it is possible to reliably realize downsizing of the apparatus.

13. Contacting and Spacing Operations in a State in which the Drawer is Loaded into the Apparatus Main Body In a state in which the drawer 4 is loaded into the apparatus main body, the driving unit 300, the contacting mechanism 75, and the spacing mechanism 91 operate as follows in accordance with a time of operation check after the apparatus is started, a time of image forming operation (for example, switching of a color mode and a monochrome mode), a stop time, and other operational situations.

As shown in FIG. 4, in a state in which the drawer 4 is loaded in the housing 2, and the translation cam 92 is moved to the frontmost position, the first inclined surfaces 97 of the respective cam parts 96 and the input parts 72 of the moving members 61 disposed respectively behind the cam parts 96, face each other so as to be out of contact with distances in the front-to-rear direction. A distance greater than a distance between the first inclined surfaces 97 of the three cam parts 96 on the rear side and the input parts 72 of the moving members 61 disposed respectively behind the three cam parts 96, is formed between the first inclined surface 97 of the frontmost cam part 96 and the input part 72 of the moving member 61 disposed behind the frontmost cam part 96. At this time, the respective pressing cams 76 come into contact with the development pressing bosses 62 of the respective process cartridges 8 from above, to press the respective development pressing bosses 62 downward. In this state, the respective process cartridges 8 are at their contacting positions, and the developing rollers 7C contact the photosensitive drums 5, and further, press the photosensitive drums 5 (color mode).

Figure 11:
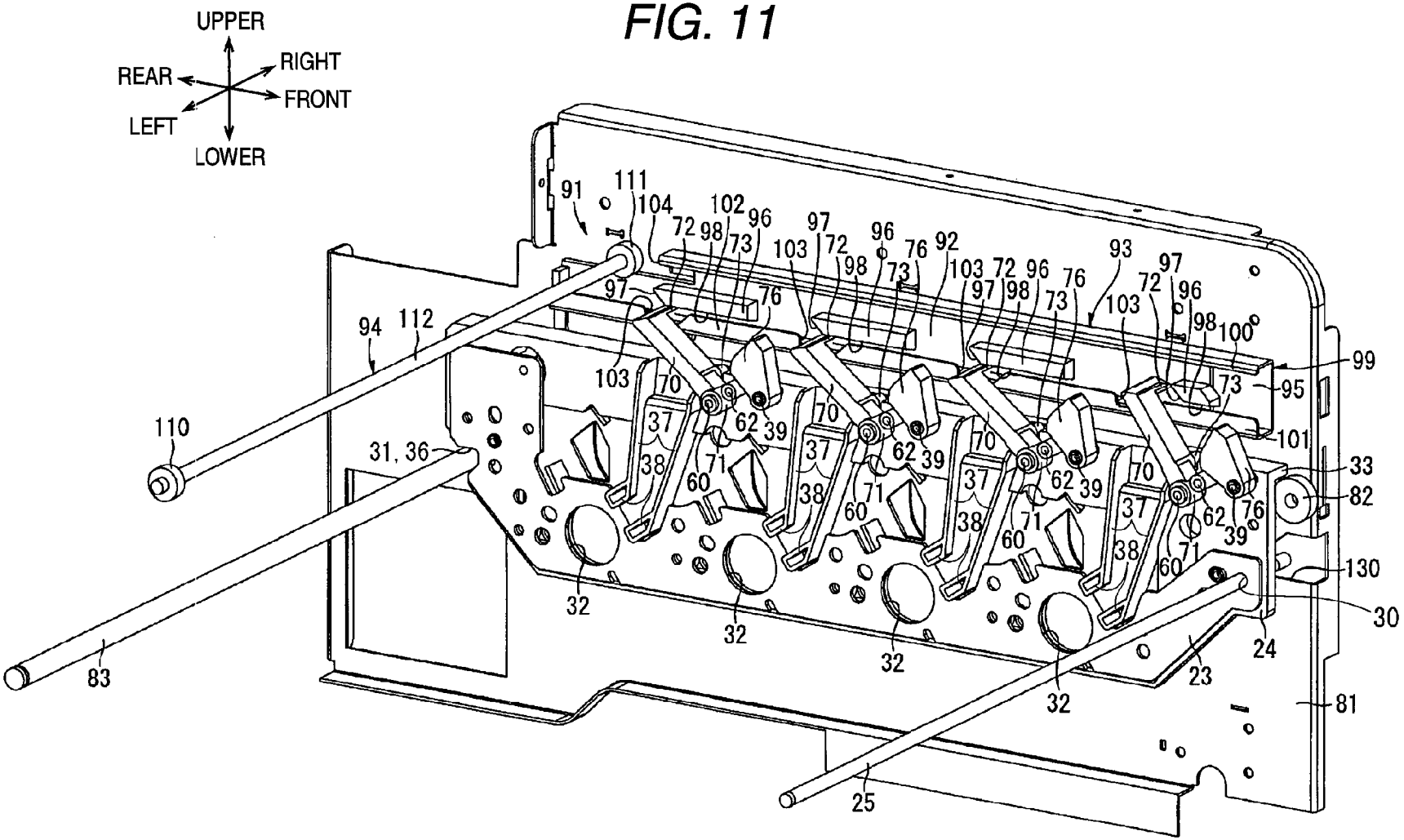
FIG. 11 is a main portion perspective view of the image forming apparatus according to the first illustrative embodiment, and shows a state in which only a developing unit for black is at the contacting position.

When the driving force of the driving unit 300 is input to the input rack gear part 92A from this state, and the right and left translation cams 92 start moving backward, as shown in FIG. 11, the first inclined surfaces 97 of the three cam parts 96 on the rear side come into contact with the input parts 72 of the three moving members 61 on the rear side disposed respectively posteriorly under the three cam parts 96, to press the input parts 72 posteriorly downward.

Figure 12:
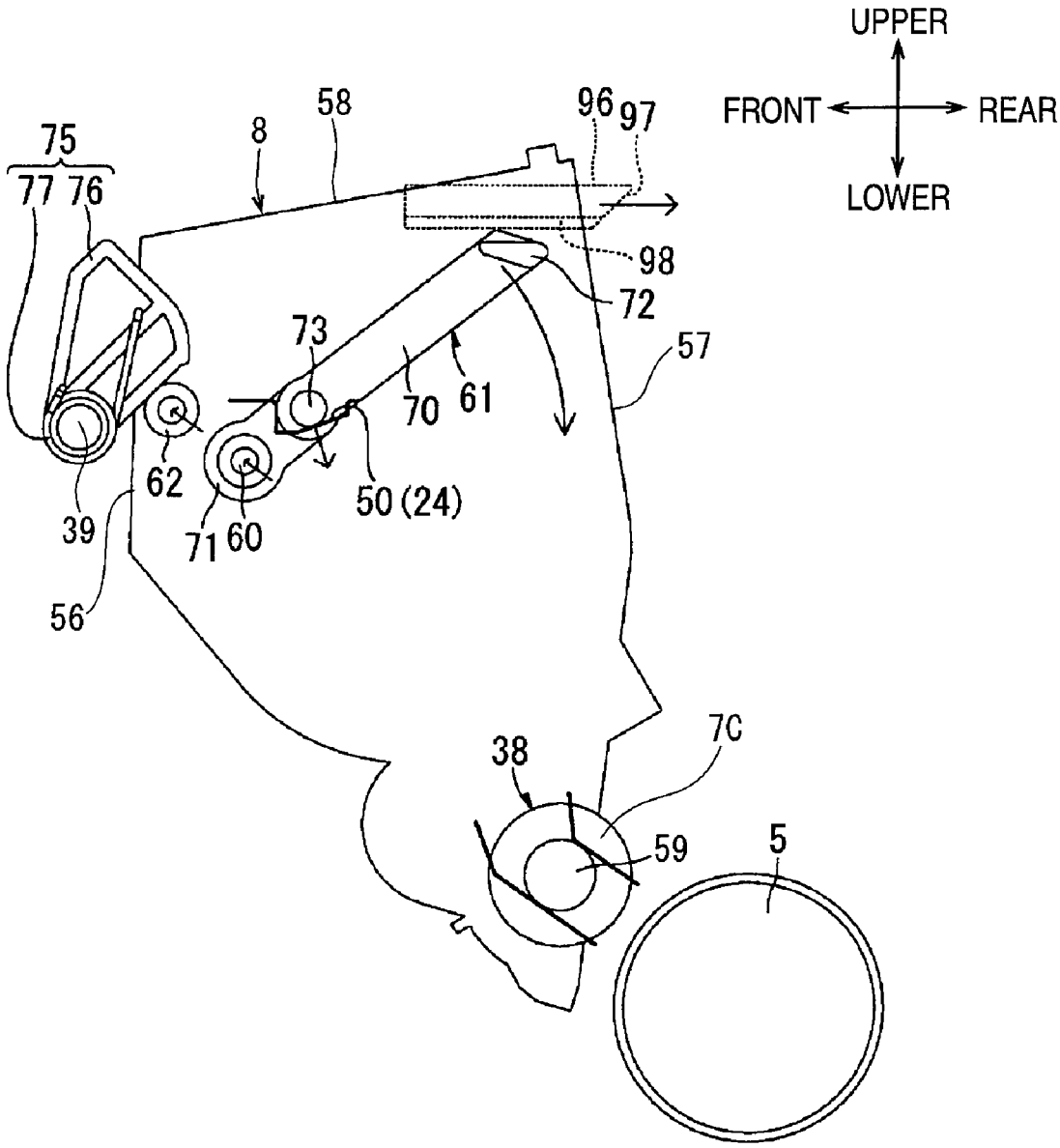
FIG. 12 is a schematic side view of the image forming apparatus according to the first illustrative embodiment, and shows a relative positional relationship of the developing unit, the image carrier, and the contacting and spacing mechanism in a state in which the developing unit is at a spacing position.

With this pressing, as shown in FIG. 12, the three moving members 61 on the rear side rotate posteriorly downward with the supporting shafts 60 as fulcrums. In the process of the rotation of the moving members 61, the bosses 73 of the respective moving members 61 come into contact with the bottom surfaces of the contact grooves 50 of the second side plate 24 from above. At this time, force having backward and downward component force is exerted to the contact grooves 50.

When the translation cams 92 further move backward, and the input parts 72 of the three moving members 61 on the rear side move relatively forward with respect to the first inclined surfaces 97 of the cam parts 96, the input parts 72 further move posteriorly downward. With this, the acting parts 71 are lifted up anteriorly upward with the bosses 73 as fulcrums. Therefore, the anteriorly-upward pressing force is imparted to the three process cartridges 8 on the rear side via the supporting shafts 60 supporting the acting parts 71 rotatably, and the process cartridges 8 are lifted upward against the pressing force imparted from the pressing cams 76.

Then, when the translation cams 92 further move backward, and the input parts 72 of the moving members 61 come into contact with the second inclined surfaces 98 of the three cam parts 96 on the rear side, the three process cartridges 8 on the rear side move to their spacing positions, and the developing rollers 7C are greatly spaced from the photosensitive drums 5. At this time, the development pressing boss 62 of the frontmost process cartridge 8 corresponding to black is pressed by the pressing cam 76. Thereby, only the developing roller 7C of the process cartridge 8 for black is brought to contact the photosensitive drum, and further, press the photosensitive drum 5 (monochrome mode).

Figure 13:
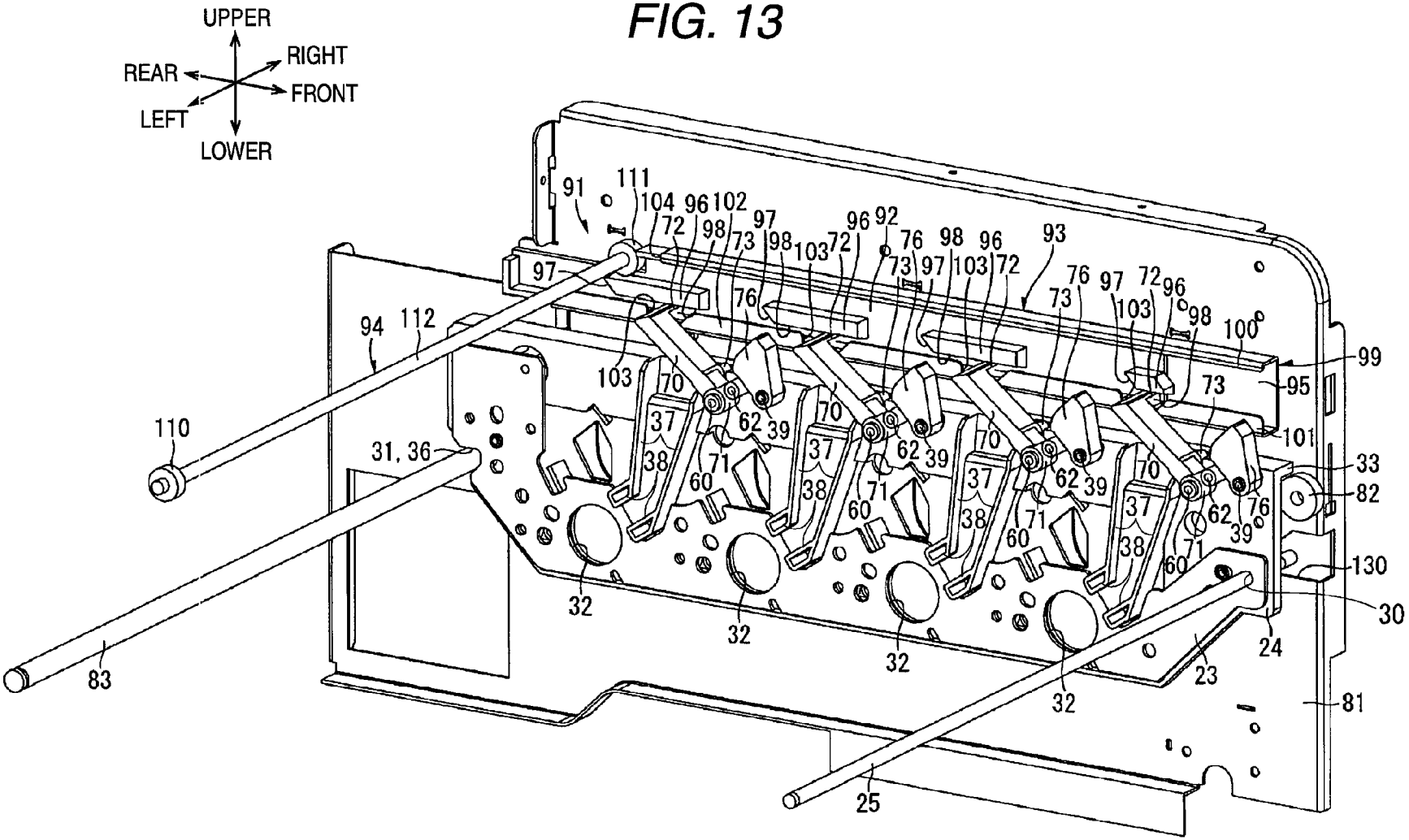
FIG. 13 is a main portion perspective view of the image forming apparatus according to the first illustrative embodiment, and shows a state in which all the developing units are at their spacing positions.

Thereafter, as shown in FIG. 13, when the translation cams 92 further move backward, the first inclined surfaces 97 of the frontmost cam parts 96 come into contact with the input parts 72 of the frontmost moving members 61 disposed behind the frontmost cam parts 96, to press one end parts of the frontmost moving members 61 posteriorly downward. With this pressing, the moving members 61 rotate backward with the supporting shafts 60 as fulcrums. In the process of the rotation of the moving members 61, the bosses 73 of the moving members 61 come into contact with the bottom surfaces of the contact grooves 50 of the second side plates 24 from above. Then, when the input parts 72 move relatively forward with respect to the first inclined surfaces 97 of the cam parts 96, the input parts 72 further move posteriorly downward. Thus, the acting parts 71 are lifted up anteriorly upward with the bosses 73 as fulcrums. Therefore, the anteriorly-upward pressing force is imparted to the frontmost process cartridge 8 via the supporting shafts 60 supporting the acting parts 71 rotatably, and the process cartridge 8 is lifted upward against the pressing force imparted from the pressing cams 76.

Then, when the translation cam 92 moves to the rearmost position, and the input parts 72 of the frontmost moving members 61 come into contact with the second inclined surfaces 98 of the frontmost cam parts 96, the process cartridge 8 for black moves to its spacing position, and the developing roller 7C is greatly spaced from the photosensitive drum 5. Thereby, the developing rollers 7C of all the process cartridges 8 are brought to be spaced from the photosensitive drums 5.

When the input parts 72 come into contact with the second inclined surfaces 98 and get into the concave parts 103 of the rail 93, pressing force including a force component in a direction inward in the width direction is imparted to the input parts 72 from the second inclined surfaces 98. The second inclined surfaces 98 inclines inward in the width direction and upward from the side of the main body part 95. As a result, positioning of the process cartridges 8 in the width direction can be performed.

14. Configurations and Operations of Interlocking Mechanism (the Arm, the First Acting Part and the Second Acting Part)

In the printer 1, at the time of removing the drawer 4 from the apparatus main body, it is necessary to move the respective process cartridges 8 to the drawn positions thereof (the contacting positions in the present illustrative embodiment) in order to prevent the interference between the respective process cartridges 8 and the apparatus main body. However, for example, when the power source is turned off for some reason in the process of an image forming operation, so as to remove the drawer 4, the situation that the respective process cartridges 8 have not moved to their drawn positions may occur. In this case also, in the printer 1, the respective process cartridges 8 are moved to their drawn positions by an interlocking mechanism (an arm 500, a first acting part 510, and a second acting part 520), etc., which will be described below in detail.

As shown in FIG. 1, the lower end part of a circular arc coupling member 3A is coupled with the left lower side of the surface facing the inside of the housing 2 of the front cover 3. As shown in FIGS. 8 and 9, in a state in which the front cover 3 is closed, the coupling member 3A is inclined upward to extend backward in the housing 2. An elongated hole 3B along the longitudinal direction of the coupling member 3A is formed in the upper end part of the coupling member 3A.

As shown in FIGS. 6, 8, and 9, the interlocking mechanism includes the arm 500. The arm 500 is an elongated plate-shaped body made of resin, and is installed on the front side of the holder member 309. A swing shaft 501 supported swingably by the apparatus main body is provided on the lower end side of the arm 500. On the other hand, an input part 502 which is provided to project outward in the width direction and is inserted through the elongated hole 3B of the coupling member 3A, is provided on the upper end side of the arm 500. As shown in FIGS. 8 and 9, when the translation cam 92 moves to the frontmost position and the rearmost position, the pressed part 92D integrally formed with the translation cam 92 draws a horizontal locus in the front-to-rear direction. The swing shaft 501 is located under the locus of the pressed parts 92D, and the input part 502 is located above the locus of the pressed parts 92D. Further, as shown in FIG. 9, the swing shaft 501 is located behind the position of the pressed part 92D when the translation cam 92 on the left side moves to the rearmost position, and the second acting part 520 which will be described later separates backward from the pressed part 92D which has moved to the rearmost position.

Figure 14:
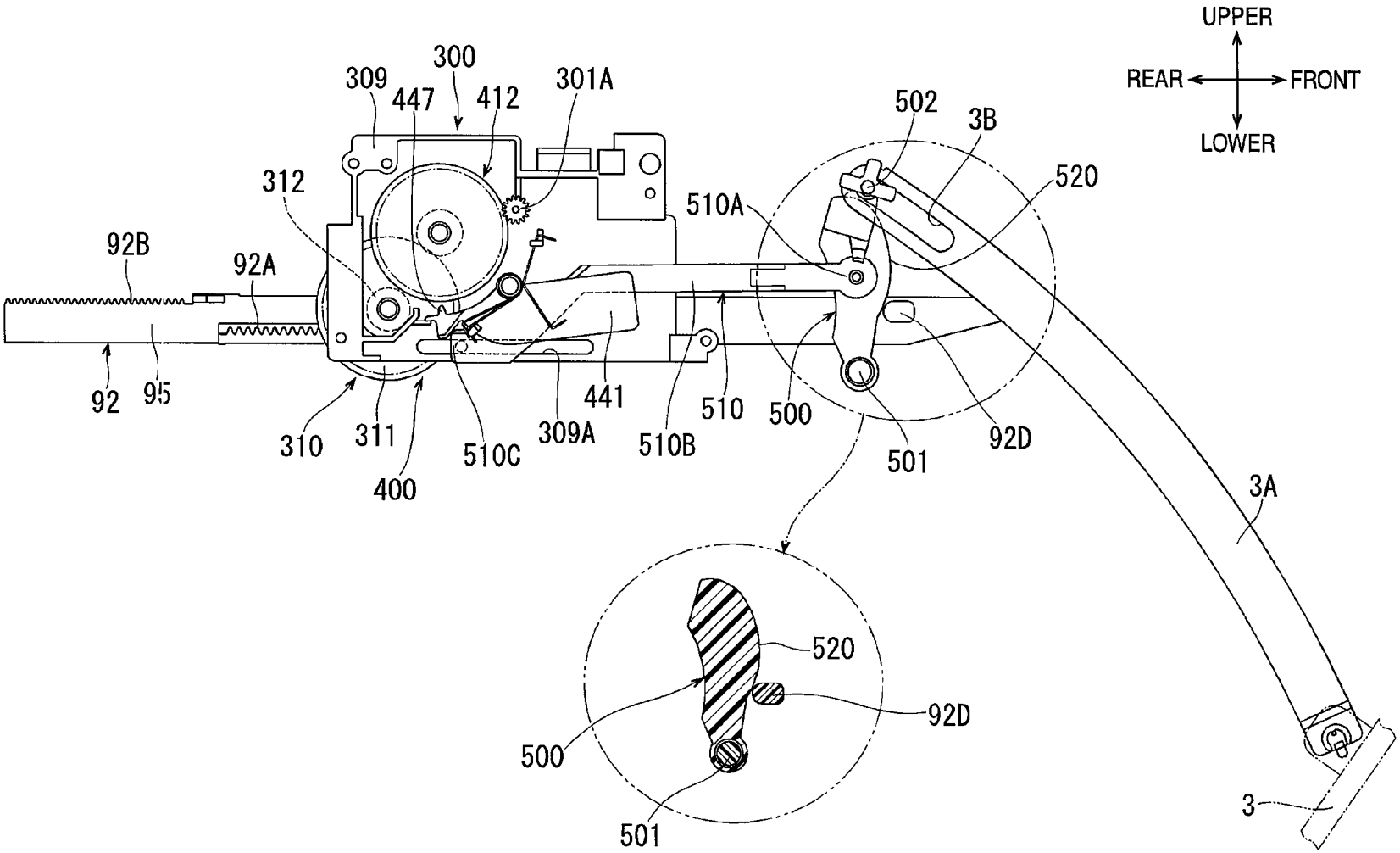
FIG. 14 is a side view of the image forming apparatus according to the first illustrative embodiment, and shows the translation cam, the driving unit, the arm, the first acting part, and the second acting part, wherein the translation cam is at the rearmost position, and the arm is in the process of being displaced from the first position toward an second position.
Figure 15:
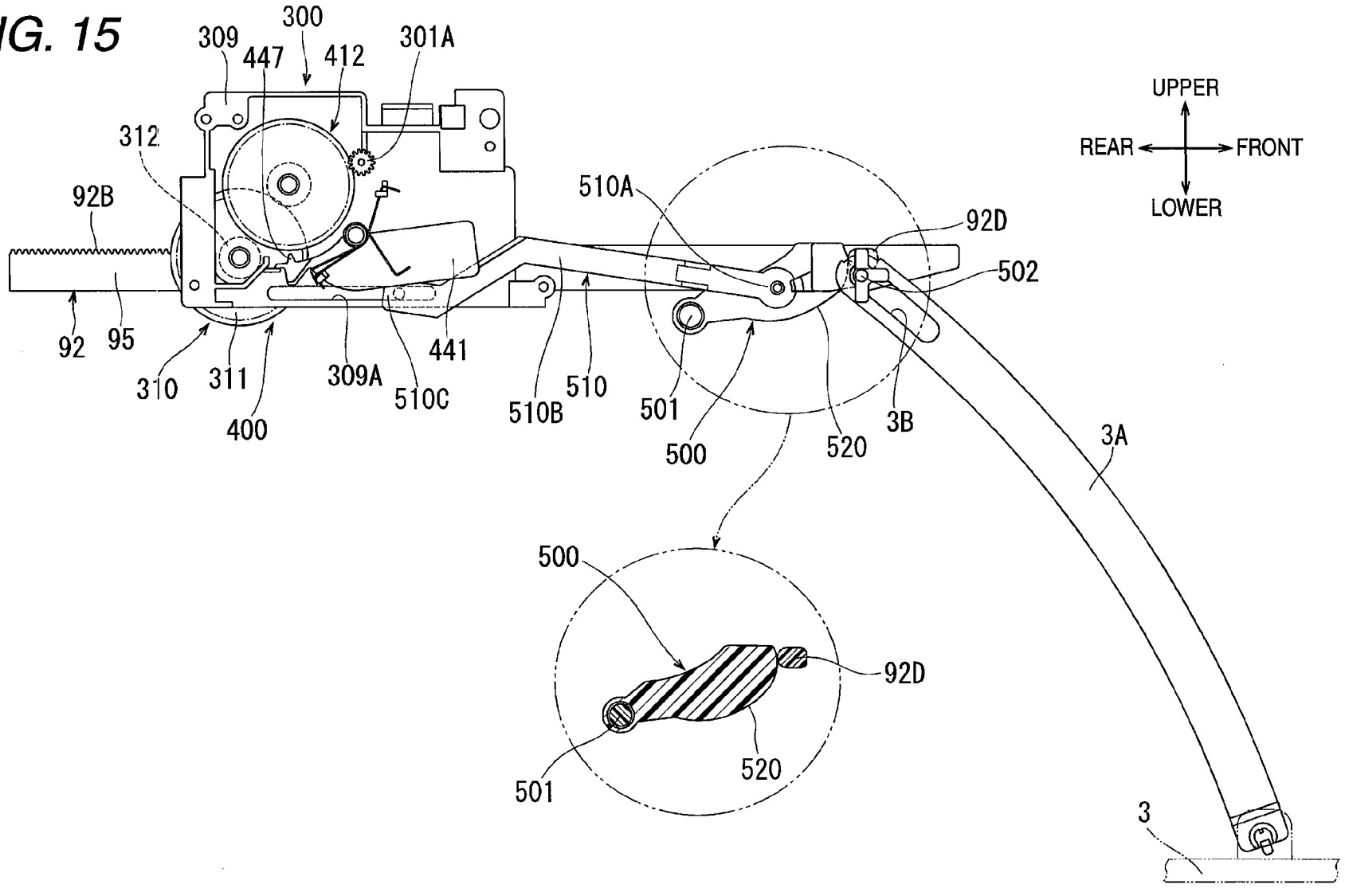
FIG. 15 is a side view of the image forming apparatus according to the first illustrative embodiment, and shows the translation cam, the driving unit, the arm, the first acting part, and the second acting part, wherein the arm is displaced to the second position and the translation cam is moved to the frontmost position.

The position of the arm 500 shown in FIGS. 8 and 9 is "first position." In this state, the input part 502 is located above the swing shaft 501, to be brought into contact with the front end part of the elongated hole 3B. Then, as shown in FIGS. 14 and 15, when the front cover 3 is opened, the input part 502 comes into contact with the rear end part of the elongated hole 3B, and the displacement of the front cover 3 is transmitted to the input part 502 via the coupling member 3A. Moreover, when the front cover 3 is opened, the arm 500 swings around the swing shaft 501 via the coupling member 3A to be gradually displaced forward. Then, the arm 500 finally moves to the position shown in FIG. 15. The position of the arm 500 shown in FIG. 15 is "second position." The interlocking mechanism including the arm 500 which moves as described above is an example of the "interlocking mechanism" which is configured to change in at least one of position, posture, and form thereof while interlocking with opening of the cover 3.

The first acting part 510 is a link member provided with the arm 500. The first acting part 510 has a front end part 510A coupled with the vertically intermediate part of the arm 500, an intermediate part 510B extending substantially-horizontally backward from the front end part 510A, and a rear end part 510C which is folded downward to extend under the rear end part of the displacement member 441 from the intermediate part 510B. The rear end part 510C engages with an elongated hole 309A elongated in the front-to-rear direction which is provided to be concave in the lower part of the holder member 309, to be allowed to move in the front-to-rear direction, and to be regulated in its movement vertically.

The second acting part 520 is a curved surface having a substantially circular arc shape in side view, which is formed on the front surface of the arm 500. The second acting part 520 extends from the swing shaft 501 side toward the upper input part 502 so as to expand gently forward, and is further curved backward directly under the input part 502.

As shown in FIGS. 8 and 9, in a state in which the arm 500 is at the "first position," the first acting part 510 keeps a state in which the rear end part 510C comes into contact with the rear end part of the displacement member 441 from underneath, to maintain the locking claw 447 to engage with the fixing gear 436. Meanwhile, the second acting part 520 is located behind the pressed part 92D with a distance, regardless of whether or not the translation cam is located at the frontmost position.

Then, when the front cover 3 is started to be opened, and the arm 500 swings up to the position shown in FIG. 14, the displacement of the arm 500 is transmitted to the first acting part 510 via the front end part 510A, and the first acting part 510 is displaced forward. With the displacement, because the rear end part 510C also separates forward from the rear end part of the displacement member 441, the rear end part of the displacement member 441 is displaced downward by the biasing force of the biasing spring, and the locking claw 447 separates from the fixing gear 436. As a result, the coupled state between the driving unit 300 and the spacing mechanism 91 is released by the action of the clutch mechanism 400 described above (an example of "first operation").

Thereafter, when the arm 500 moves to the second position shown in FIG. 15, the first acting part 510 is also further displaced forward according to the movement. However, the first acting part 510 is kept spaced from the rear part of the displacement member 441.

Here, in the case in which all the process cartridges 8 are not moved to their drawn positions (contacting positions), the translation cam 92 does not move to the frontmost position shown in FIG. 8, and is at the rearmost position shown in FIG. 9 or a position intermediate between the positions in FIGS. 8 and 9. Therefore, the second acting part 520 contacts the pressed part 92D to move the pressed part 92D to the frontmost position in accordance with the arm 500 being displaced from the position shown in FIG. 14 to the second position shown in FIG. 15.

A description will be given in more detail by use of the case in which the translation cam 92 is at the rearmost position shown in FIG. 9 as an example. Immediately after the first acting part 510 releases the coupled state between the driving unit 300 and the spacing mechanism 91, the second acting part 520 is brought to contact the pressed part 92D with its lower end side. Then, when the arm 500 is further displaced forward, the contact position between the second acting part 520 and the pressed part 92D moves forward in regard of the swing shaft 501, to push the translation cam 92 forward. Then, when the arm 500 is displaced to the second position shown in FIG. 15, the upper end side of the second acting part 520 most distant from the swing shaft 501 is brought to contact the pressed part 92D, to move the translation cam 92 to the frontmost position. As a result, all the process cartridges 8 are brought to move to their drawn positions (contacting positions) by the interlock operation of the contacting mechanism 75 and the spacing mechanism 91 described above (an example of "second operation").

Here, after the first acting part 510 releases the coupled state between the driving unit 300 and the spacing mechanism 91, the second acting part 520 contacts the pressed part 92D to move the translation cam 92 to the frontmost position. Therefore, it is possible for a user to open the front cover 3 smoothly without the resistance from the electric motor 301. Further, at this time, if the coupled state between the driving unit 300 and the spacing mechanism 91 is not released, driving force is transmitted in the opposite direction to the electric motor 301 by the movement of the translation cam 92, which may cause the electric motor 301 or the driving transmission unit 310 to break down. However, such trouble can also be prevented by the above-described configuration.

Further, because the output point (the second acting part 520) is located between the fulcrum (the swing shaft 501) and the input point (the input part 502), even when an input of an opening operation of the front cover 3 is small, the second acting part 520 presses the pressed part 92D with great pressing force by the principle of leverage, which makes it possible to reliably move the translation cam 92.

Meanwhile, the operations of the arm 500, the first acting part 510, the second acting part 520, etc., at the time of closing the front cover 3 after the drawer 4 is loaded into the apparatus main body, are opposite to the operations at the time of opening the front cover 3. At this time, the input part 502 comes into contact with the front end part of the elongated hole 3B of the coupling member 3A to be pushed backward, which causes the arm 500 to be displaced from the state shown in FIG. 14 to the first position shown in FIG. 8 or 9. Therefore, the displacement of the arm 500 is transmitted to the first acting part 510 via the front end part 510A, and the first acting part 510 is displaced backward. With the displacement, the rear end part 510C gets under the rear end part of the displacement member 441, to cause the rear end part of the displacement member 441 to be displaced upward against the biasing force of the biasing spring, and therefore, the locking claw 447 engages with the fixing gear 436. As a result, the driving unit 300 and the spacing mechanism 91 is caused to be in a coupled state by the action of the clutch mechanism 400 described above. With this configuration, there is no need for a user to carry out a special operation for restoring the coupled state, and it is possible to easily load the drawer 4 into the apparatus main body.

<Functions and Effects>

In the printer 1 of the first illustrative embodiment, when the front cover 3 is opened at the time of removing the drawer 4 from the apparatus main body, the interlocking mechanism changes in position and posture thereof (the swinging of the arm 500 around the swing shaft 501) while interlocking with opening of the cover 3. During the change, the interlocking mechanism performs the first operation (the operation of releasing the coupled state between the driving unit 300 and the contacting and spacing mechanism 91) and the second operation (the operation of moving the respective process cartridges 8 to the drawn positions (contacting positions)) by the arm 500, the first acting part 510, and the second acting part 520, while the first operation and the second operation interlocking with each other. Therefore, there is no need for a user to carry out an operation of releasing the coupled state between the driving unit 300 and the contacting and spacing mechanism 91 or an operation of moving the respective process cartridges 8 to their drawn positions at the time of opening the front cover 3.

In particular, in the printer 1, the interlocking mechanism is provided with the arm 500, and the arm 500 has the first and second acting parts 510 and 520. Therefore, as compared with the above-described related-art image forming apparatus having a configuration in which the mechanism group of "the handling piece, the lever forward-backward mechanism, and the clutch switching lever" and the mechanism group of "the link mechanism, the cover interlocking-moving member, and the second clutch mechanism" separately operate, it is possible to achieve simplification of the apparatus and reduction in the number of components, which makes it possible to reduce a space in the apparatus main body for disposing the arm 500, the first and second acting parts 510 and 520, etc.

Accordingly, the printer 1 of the first illustrative embodiment allows the drawer 4 including the photosensitive drums 5 and the process cartridges 8 to be easily removed from the apparatus main body and the downsizing of the apparatus can be realized.

Further, in this printer 1, the contacting and spacing operations of the process cartridges 8 are achieved by the simple translation cams 92. At this time, a direction in which the pressed part 92D is displaced and a direction in which the input rack gear part 92A is displaced are configured to match each other, which makes it possible to easily realize the apparatus configuration that corresponds to a case in which the translation cams 92 reciprocates by the driving force from the driving unit 300 and a case in which the translation cams 92 slide by an opening operation of the front cover 3.

(Second Illustrative Embodiment)

As shown in FIGS. 16 to 19, in a printer of a second illustrative embodiment, driving unit 600 is adopted in place of the driving unit 300 of the printer 1 of the first illustrative embodiment, a clutch mechanism 700 is adopted in place of the clutch mechanism 400, and a first acting part 810 is adopted in place of the first acting part 510. The other configurations are the same as those of the first illustrative embodiment. Therefore, the same configurations as in the first illustrative embodiment are denoted by the same reference numerals, and descriptions thereof will be omitted or simplified.

Figure 17:
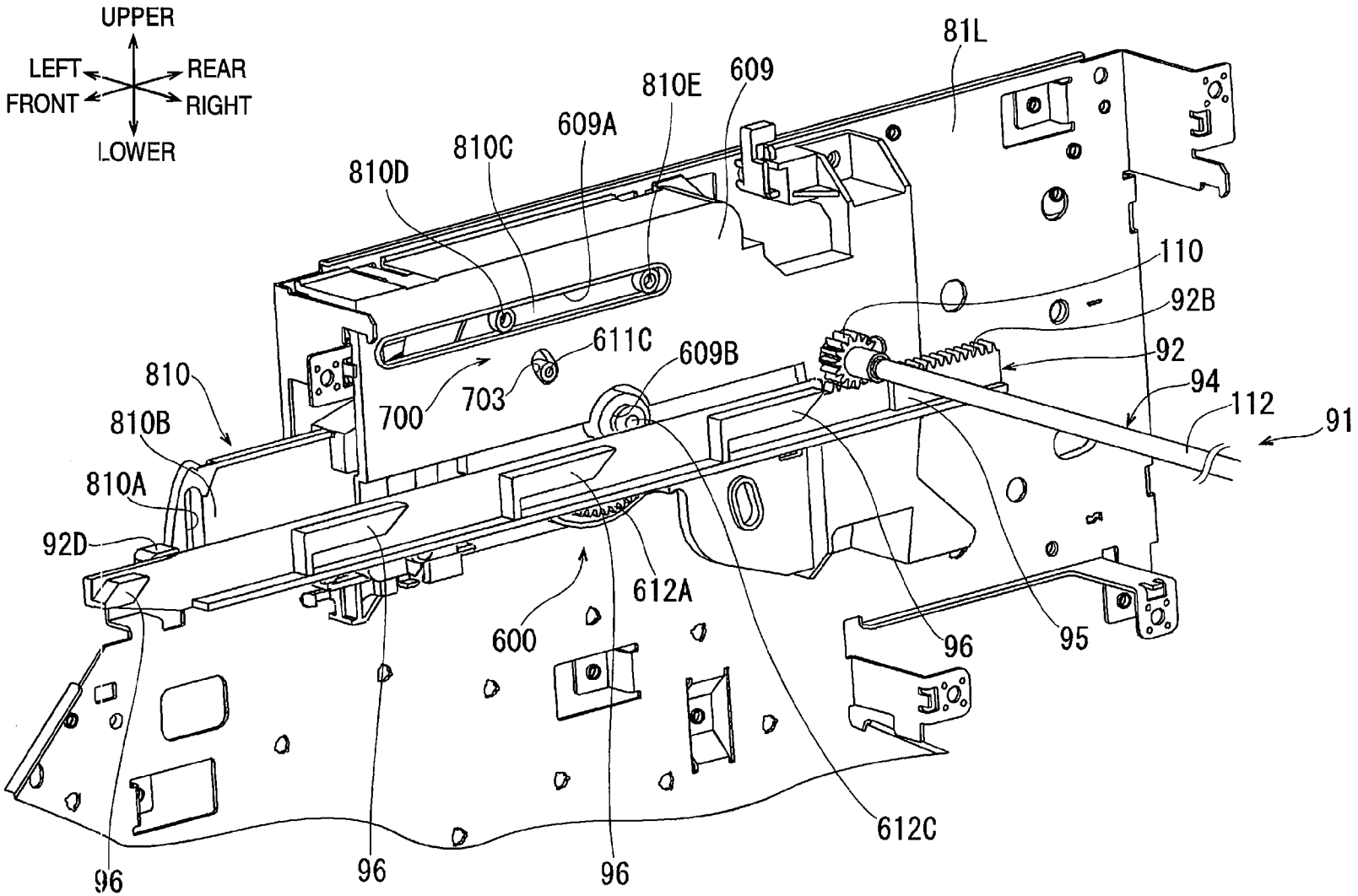
FIG. 17 is a perspective view of the image forming apparatus according to the second illustrative embodiment, and shows the translation cam, the driving unit, and the first acting part which are extracted.

As shown in FIG. 17, in the printer of the second illustrative embodiment, a holder member 609 is fixed to the side surface facing the translation cam 92 of a main body side plate 81L on the left side of the housing 2.

Figure 16:
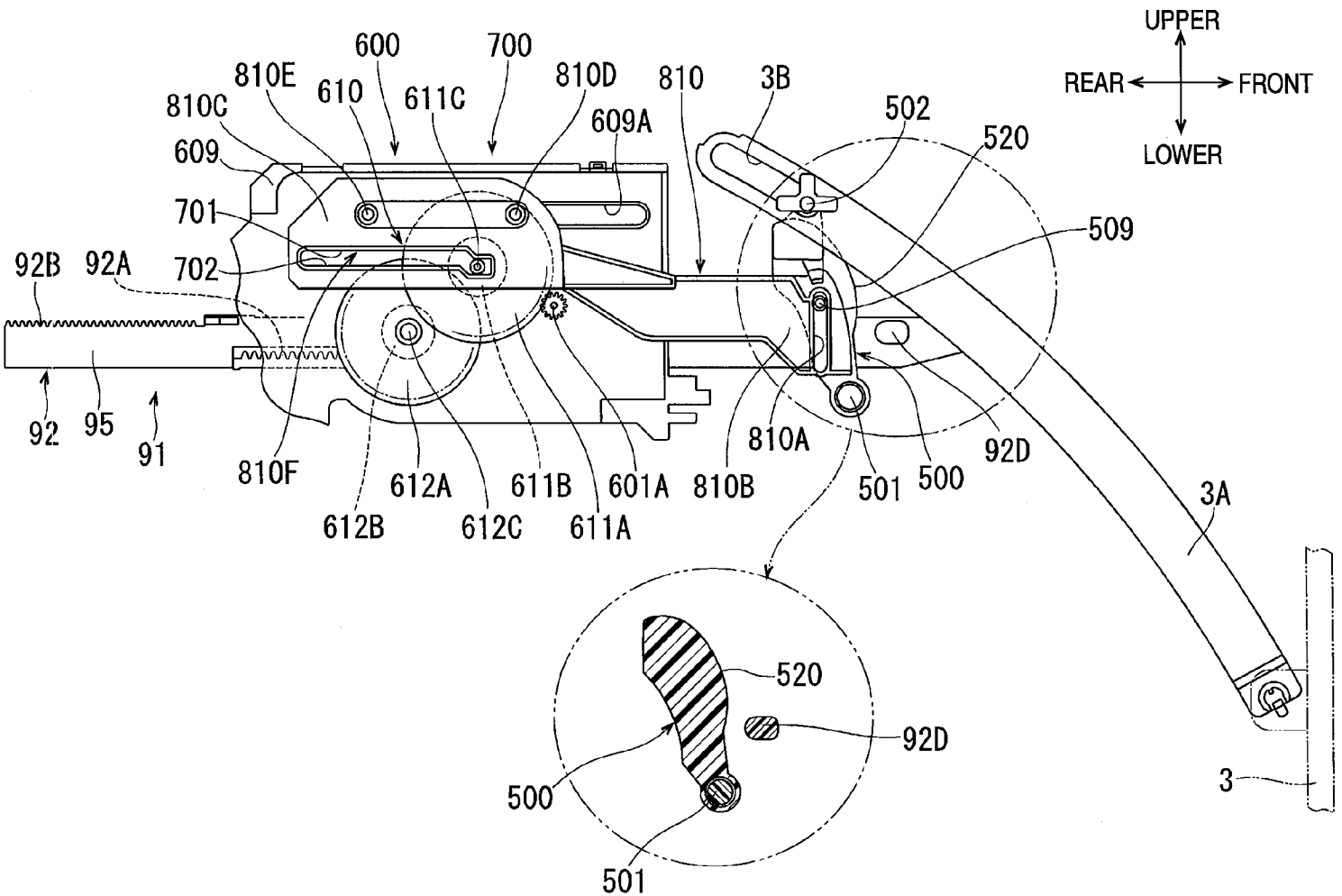
FIG. 16 is a side view of an image forming apparatus according to a second illustrative embodiment, and shows a translation cam, a driving unit, an arm, a first acting part, and a second acting part, wherein the translation cam is at the rearmost position and the arm is at the first position.
Figure 18:
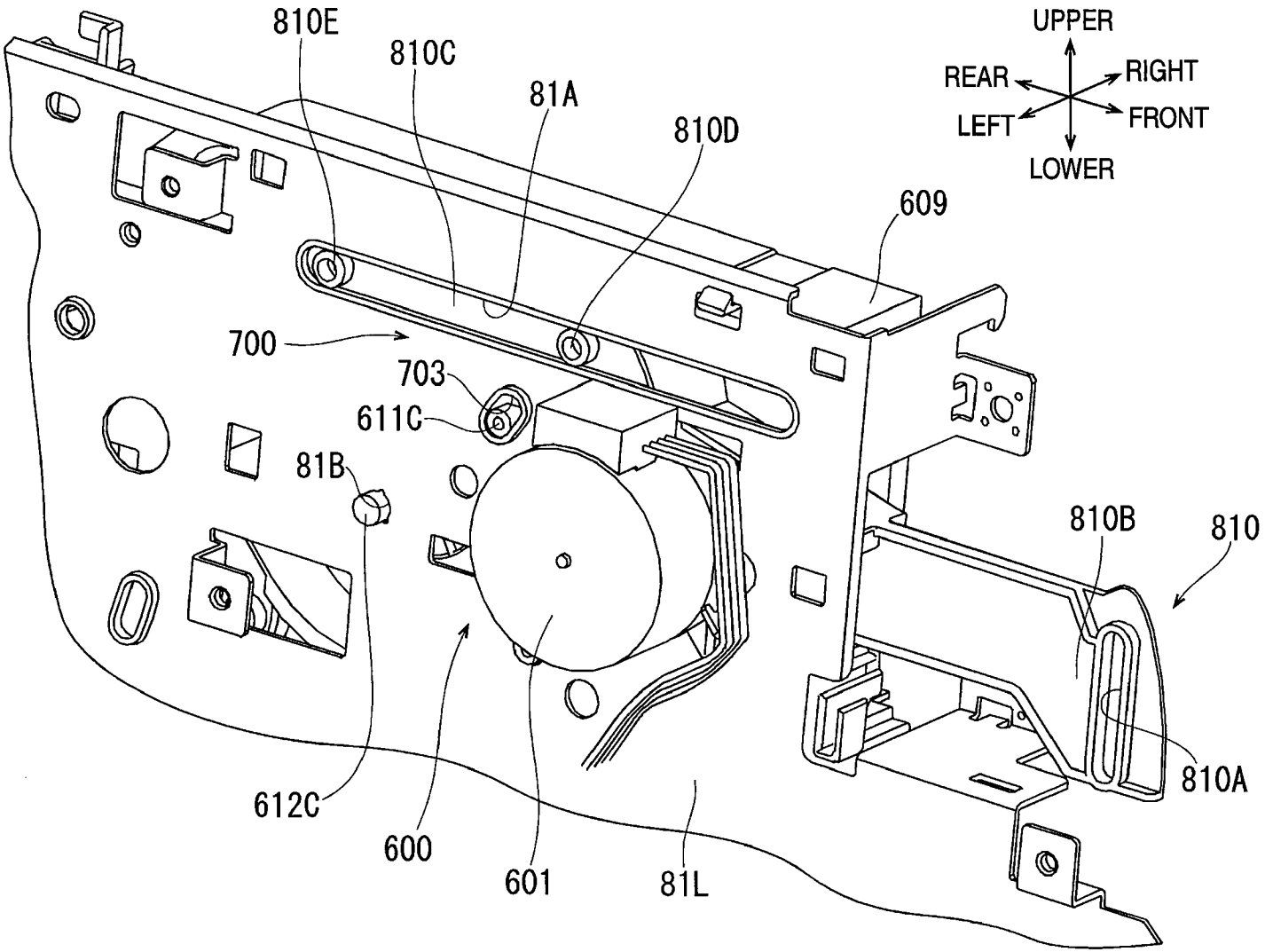
FIG. 18 is a perspective view of the image forming apparatus according to the second illustrative embodiment, and shows the driving unit and the first acting part which are extracted.
Figure 19:
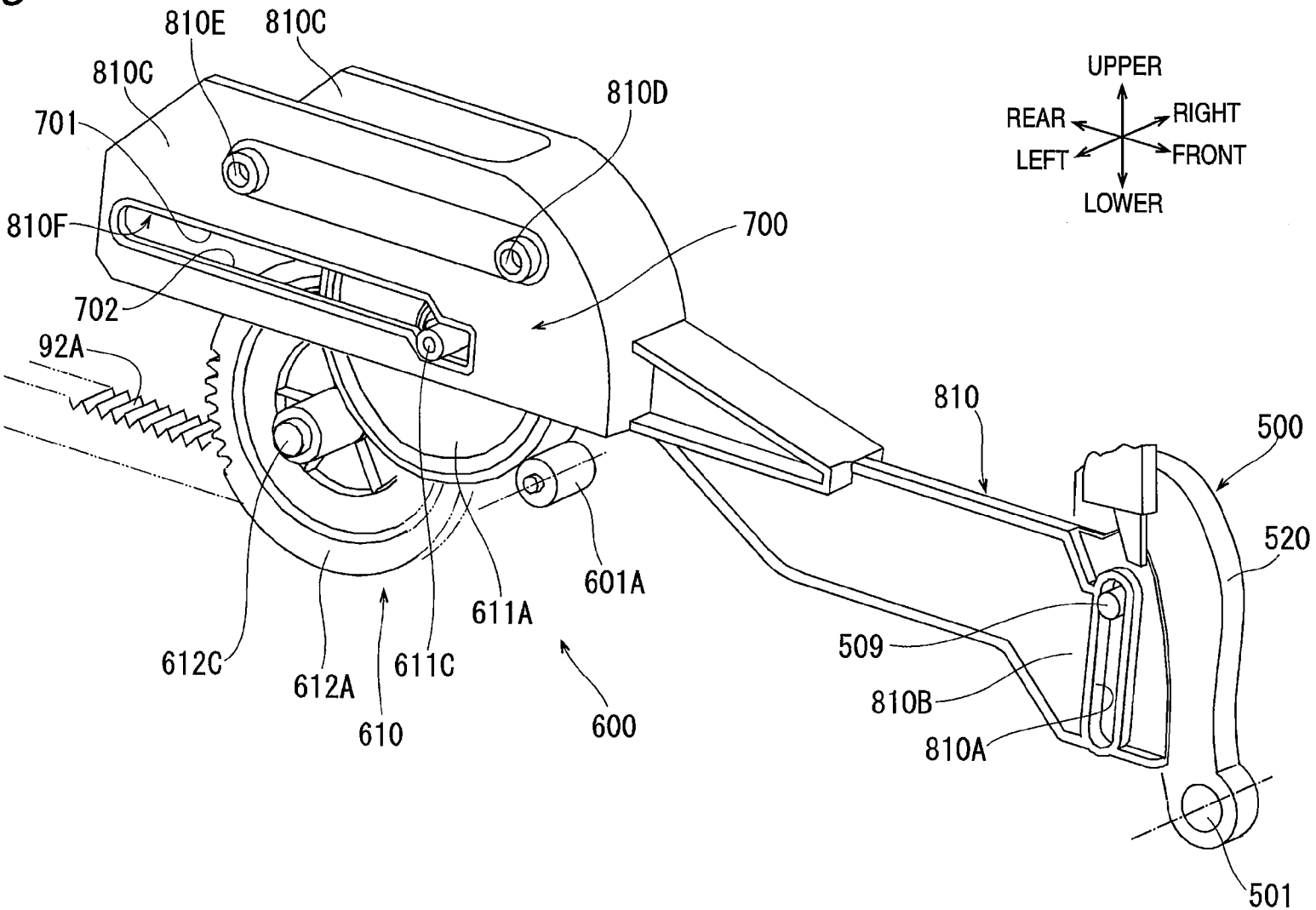
FIG. 19 is a perspective view of the image forming apparatus according to the second illustrative embodiment, and shows the first acting part, a large diameter gear (a first gear is integrally formed on the right side of the large diameter gear, that is hidden in FIG. 18), a second gear, and an input rack gear part which are extracted.

As shown in FIGS. 17 to 19, with respect to the first acting part 810, a rear end part 810C thereof is housed in a space partitioned with the main body side plate 81L and the holder member 609, and its front end part 810B projects so as to be elongated and flattened from the space. A vertically-long elongated hole 810A is provided to penetrate through the front end part 810B, and as shown in FIGS. 16 and 19, a columnar shaft 509 projecting from the arm 500 is inserted into the elongated hole 810A, to be movable up and down inside the elongated hole 810A.

As shown in FIG. 19, the rear end part 810C of the first acting part 810 is a section of a pair of flat plates which is two-forked from the front end part 810B, to face each other while extending backward. Because the right side of the rear end part 810C has the same shape as the left side of the rear end part 810C, that is symmetrical, only the left side of the rear end part 810C is illustrated in FIG. 19, and the illustration of the right side thereof is omitted.

A pair of columnar convex portions 810D projecting in its right-to-left direction and a pair of columnar convex portions 810E projecting in its right-to-left direction which are distant backward from the respective columnar convex portions 810D are formed on the side surfaces facing outward to the right and left sides of the respective rear end parts 810C. As shown in FIG. 17, an elongated hole 609A extending in the front-to-rear direction is provided to penetrate through the holder member 609, and the columnar convex portions 810D and 810E on the right side are inserted into the elongated hole 609A, to be movable forward and backward inside the elongated hole 609A. Further, as shown in FIG. 18, an elongated hole 81A extending in the front-to-rear direction is provided to penetrate through the main body side plate 81L as well, and the columnar convex portions 810D and 810E on the left side are inserted into the elongated hole 81A, to be movable forward and backward inside the elongated hole 81A. When the arm 500 swings around the swing shaft 501, its displacement is transmitted to the first acting part 810 via the columnar shaft 509 and the elongated hole 810A. At this time, the first acting part 810 is guided by the respective columnar convex parts 810D and 810E and the elongated holes 609A and 81A to be slidable forward and backward as shown in FIG. 16 (the rearmost position), and FIG. 21 and FIG. 23 (the frontmost position).

Figure 20:
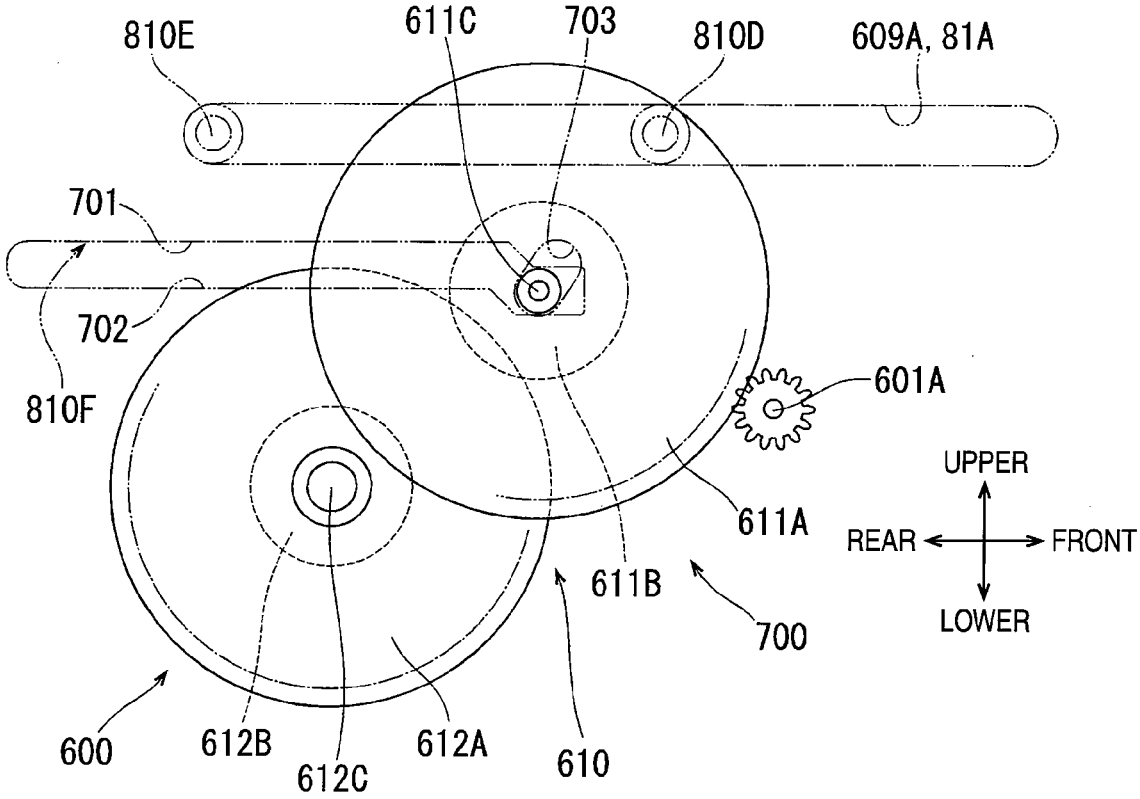
FIG. 20 is a schematic diagram of the image forming apparatus according to the second illustrative embodiment, and shows a state in which a gear distance changing mechanism makes the first gear and the second gear come close to each another, as a result, the first gear and the second gear mesh with each another to restore the transmission of the driving force.

As shown in FIG. 19, under the respective columnar convex parts 810D and 810E, a pair of right and left guide holes 810F extending in the front-to-rear direction is provided to penetrate through the side surfaces facing outward to the right and left sides of the respective rear end parts 810C. The respective guide holes 810F are cranked on their front end sides. In more detail, as shown in FIG. 20, in the inner wall surface of each of the respective guide holes 810F, a surface which horizontally extends short backward from the front end side, and is thereafter inclined upward to further horizontally extend backward is a first guide surface 701. Further, in the inner wall surface of each of the respective guide holes 810F, a surface which horizontally extends short backward from the front end side, and is thereafter inclined upward to further horizontally extend backward is a second guide surface 702. The second guide surface 702 is located with a predetermined distance under the first guide surface 701. The distance between the first guide surface 701 and the second guide surface 702 is set to be slightly greater than a shaft diameter of a first gear rotating shaft 611C which will be described later. The first guide surface 701 and the second guide surface 702 configure the clutch mechanism 700 which will be described later.

As shown in FIGS. 16 and 17, the driving unit 600 for driving the spacing mechanism 91 is housed in the space partitioned with the main body side plate 81L and the holder member 609. FIG. 16 shows a state in which the translation cam 92 is driven by the driving unit 600 to move to the rearmost position.

The driving unit 600 has an electric motor 601 (refer to FIG. 18), a driving transmission unit 610 (refer to FIG. 16) that transmits driving force of the electric motor 601 to the input rack gear part 92A, and the clutch mechanism 700 (refer to FIG. 16).

As shown in FIG. 18, the electric motor 601 is fixed to the side surface opposite to the holder member 609 on the main body side plate 81L, and a pinion gear 601A (refer to FIGS. 16 and 19) thereof is projected out to the side of the holder member 609.

As shown in FIGS. 16 and 19, the driving transmission unit 610 has a driving force input gear 611A meshing with the pinion gear 601A, a first gear 611B, which is coaxially formed to be integrated with the driving force input gear 611A, with a diameter smaller than that of the driving force input gear 611A (refer to FIG. 16. The first gear 611B is located on the back side of the sheet plane from the driving force input gear 611A in FIG. 16), and a pair of the right and left first rotating shafts 611C which are coaxially formed to be integrated with the driving force input gear 611A and the first gear 611B, and project in the right-to-left direction.

Further, the driving transmission unit 610 has a second gear 612A obliquely under the first gear 611B, a driving force output gear 612B, which is coaxially formed to be integrated with the second gear 612A, with a diameter smaller than that of the second gear 612A (refer to FIG. 16. The driving force output gear 612B is located on the back side of the sheet plane from the second gear 612A in FIG. 16), and a pair of right and left second rotating shafts 612C which are coaxially formed to be integrated with the second gear 612A and the driving force output gear 612B, and project in the right-to-left direction. The driving force output gear 612B meshes with the input rack gear part 92A.

As shown in FIG. 17, the second rotating shaft 612C on the right side is supported rotatably in a shaft hole 609B provided in the holder member 609. Further, as shown in FIG. 18, the second rotating shaft 612C on the left side is supported rotatably in the shaft hole 81B provided in the main body side plate 81L.

On the other hand, as shown in FIG. 19, the respective first rotating shafts 611C are inserted into the respective guide holes 810F. The respective first rotating shafts 611C are sandwiched between the upper first guide surfaces 701 and the lower second guide surfaces 702 to be relatively movable with respect to the respective guide holes 810F. As shown in FIGS. 17 and 18, a pair of right and left first gear supporting parts 703 is provided to penetrate through a portion under the elongated hole 609A of the holder member 609 and a portion under the elongated hole 81A of the main body side plate 81L. The respective first gear supporting parts 703 are formed into short elongated hole shapes, and inclined forward such that their upper end sides are separated from the second gear 612A. Then, the end parts of the respective first rotating shafts 611C are inserted into the respective first gear supporting parts 703. The respective first gear supporting parts 703 having the above-described configurations allow the respective first rotating shafts 611C to move in the longitudinal direction of the elongated hole shapes in the respective first gear supporting parts 703, i.e., the first gear 611B integrated with the respective first rotating shafts 611C to come close to or separate from the second gear 612A, while supporting the respective first rotating shafts 611C rotatably.

In a state in which an image forming operation is possible, i.e., in a state in which the drawer 4 is loaded in the apparatus main body and the front cover 3 is closed, as shown in FIG. 16, the arm 500 is at the first position, and the first acting part 810 is located at the rearmost position. In this case, as shown as an enlarged view in FIG. 20, since the horizontal surfaces on the front side of the respective first guide surfaces 701 push down the respective first rotating shafts 611C from above, the respective first rotating shafts 611C come into contact with the lower end edges of the elongated hole shapes in the respective first gear supporting parts 703 to stop. In this state, since the first gear 611B comes close to the second gear 612A so as to mesh with each other, a route for transmitting driving force from the electric motor 601 to the input rack gear part 92A is connected. Therefore, when the electric motor 601 rotates, the driving force of the electric motor 601 is transmitted to the input rack gear part 92A, and the translation cam 92 formed to be integrated with the input rack gear part 92A straightly moves forward or backward.

Here, in the case where the translation cam 92 straightly moves backward, the pinion gear 601A, the second gear 612A, and the driving force output gear 612B rotate in the clockwise direction toward the sheet plane of FIG. 16. With this, downward reaction force due to the meshing is imparted to the first gear 611B to press the first gear 611B downward. At this time, since the respective first rotating shafts 611C come into contact with the lower end edges of the elongated hole shapes in the respective first gear supporting parts 703 to stop, a distance between the first gear 611B and the second gear 612B is kept within an appropriate range.

Further, in the case where the translation cam 92 straightly moves forward, the pinion gear 601A, the second gear 612A, and the driving force output gear 612B rotate in the anticlockwise direction toward the sheet plane of FIG. 16. With this, the upward reaction force due to the meshing is imparted to the first gear 611B to press the first gear 611B upward. At this time, since the respective first rotating shafts 611C come into contact with the horizontal surfaces on the front side of the respective first guide surfaces 701 to stop, a distance between the first gear 611B and the second gear 612A is kept within an appropriate range.

Figure 21:
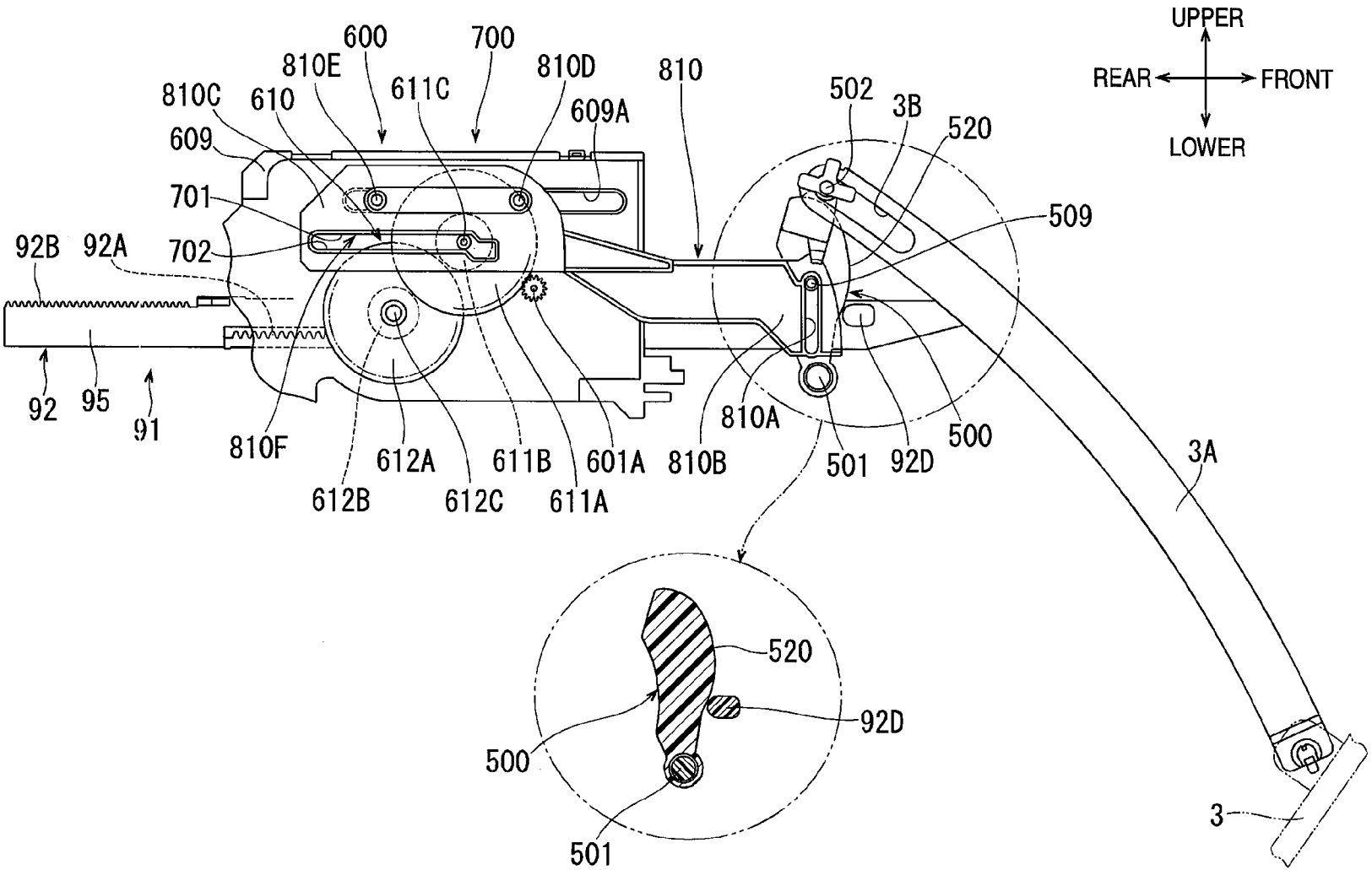
FIG. 21 is a side view of the image forming apparatus according to the second illustrative embodiment, and shows the translation cam, the driving unit, the arm, the first acting part, and the second acting part, wherein the translation cam is at the rearmost position, and the arm is in the process of being displaced from the first position toward an second position.
Figure 22:
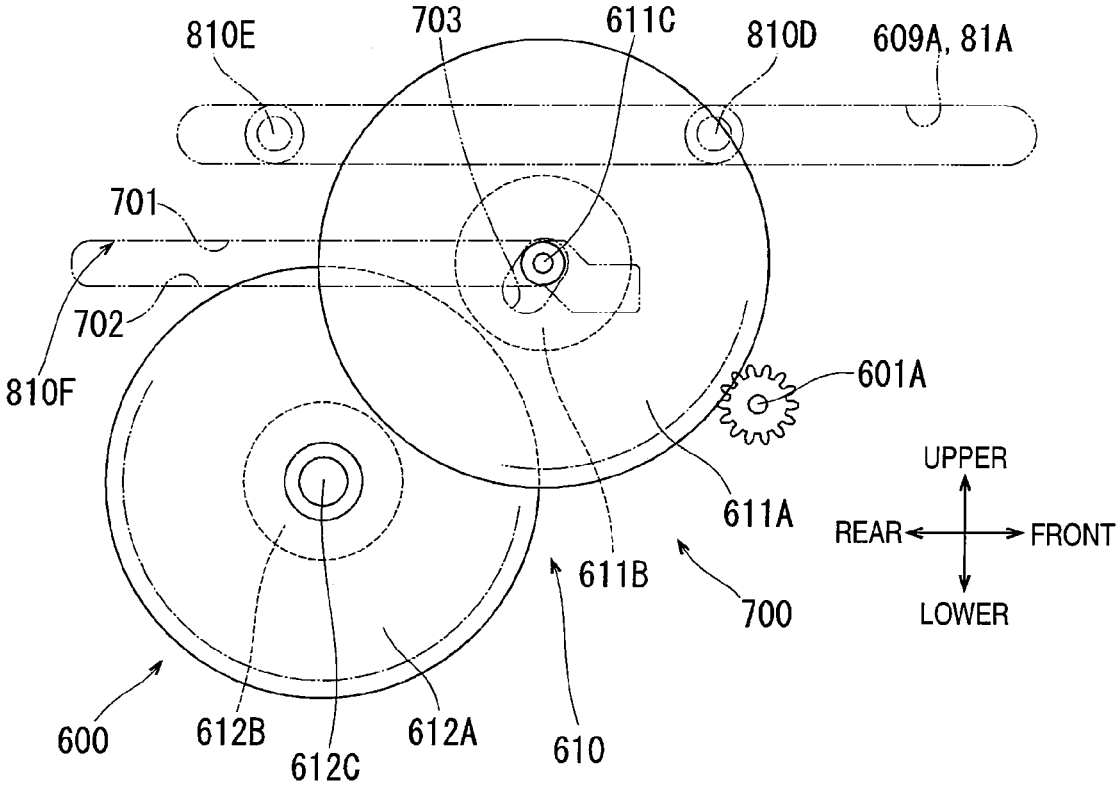
FIG. 22 is a schematic diagram of the image forming apparatus according to the second illustrative embodiment, and shows a state in which the gear distance changing mechanism separates the first gear and the second gear from each other, as a result, the first gear and the second gear do not mesh with each another to discontinue the transmission of the driving force.

On the other hand, when the drawer 4 is drawn out from the apparatus main body, as shown in FIG. 21, the arm 500 swings forward around the swing shaft 501 while interlocking with opening of the front cover 3, and the first acting part 810 also moves forward in accordance therewith. With this, as shown as an enlarged view in FIG. 22, since the inclined surfaces and the horizontal surfaces on the rear side of the respective second guide surfaces 702 push up the respective first rotating shafts 611C from underneath, the respective first rotating shafts 611C come into contact with the upper end edges of the elongated hole shapes in the respective first gear supporting parts 703 to stop. In this state, since the first gear 611B is separated from the second gear 612A, and they do not mesh with each other, the route for transmitting driving force from the electric motor 601 to the input rack gear part 92A is blocked. As a result, the transmission of the driving force from the electric motor 601 to the input rack gear part 92A is discontinued (an example of "the first operation").

Figure 23:
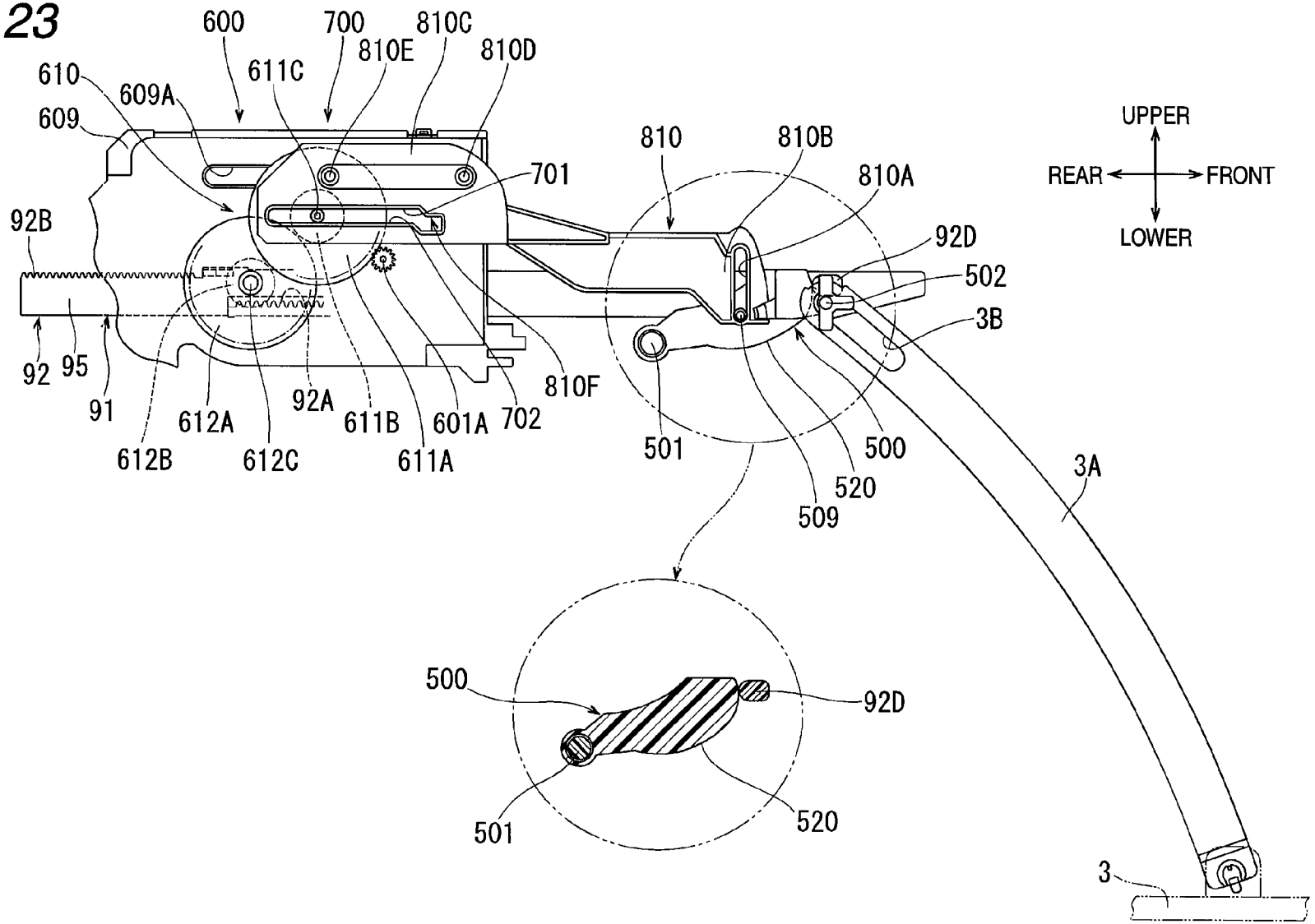
FIG. 23 is a side view of the image forming apparatus according to the second illustrative embodiment, and shows the translation cam, the driving unit, the arm, the first acting part, and the second acting part, wherein the arm is displaced to the second position and the translation cam is moved to the frontmost position.

Moreover, when the front cover 3 is completely opened, the arm 500 moves to the second position shown in FIG. 23. According to that movement, the first acting part 810 is also further displaced forward. During this time, the horizontal surfaces on the rear sides of the first guide surfaces 701 and the second guide surfaces 702 merely move forward while slidingly contacting the first rotating shafts 611C, and the first gear 611B and the second gear 612A are kept separated from each other.

In addition, the second acting part 520 contacts the pressed part 92D to move the pressed part 92D to the frontmost position in accordance with the arm 500 being displaced from the position shown in FIG. 21 to the second position shown in FIG. 23. As a result, as described in the first illustrative embodiment, all the process cartridges 8 are brought to move to their drawn positions (contacting positions) by the cooperative operation of the contacting mechanism 75 and the spacing mechanism 91 described above (an example of "the second operation").

Further, at the time of closing the front cover 3, as shown in FIGS. 21 and 16, the arm 500 swings backward around the swing shaft 501, and the first acting part 810 also moves backward in accordance therewith. With this, as shown as an enlarged view in FIG. 20, since the inclined surfaces on the front sides and the horizontal surfaces of the respective first guide surfaces 701 push down the respective first rotating shafts 611C from above, the first gear 611B and the second gear 612A mesh with each other, to transmit the driving force from the electric motor 601 to the input rack gear part 92A.

A "gear distance changing mechanism" of the present invention includes the first gear supporting parts 703, the first guide surfaces 701, and the second guide surfaces 702. Further, the clutch mechanism 700 includes the gear distance changing mechanism, the first gear 611B, and the second gear 612A.

<Functions and Effects>

In the printer of the second illustrative embodiment, when the front cover 3 is opened at the time of drawing the drawer 4 from the apparatus main body, the interlocking mechanism performs the first operation (the operation of releasing the coupled state between the driving unit 600 and the contacting and spacing mechanism 91) and the second operation (the operation of moving the respective process cartridges 8 to the drawn positions (contacting positions)) by the arm 500, the first acting part 810, and the second acting part 520, while the first operation and the second operation interlocking with each other. Therefore, there is no need for a user to carry out an operation of releasing the coupled state between the driving unit 600 and the contacting and spacing mechanism 91 or an operation of moving the respective process cartridges 8 to their drawn positions at the time of opening the front cover 3.

In particular, in this printer, the interlocking mechanism is provided with the arm 500, and the arm 500 has the first and second acting parts 810 and 520. Therefore, as compared with the above-described related-art image forming apparatus, it is possible to achieve simplification of the apparatus and reduction in the number of components, which makes it possible to reduce space in the apparatus main body for disposing the arm 500, the first and second acting parts 810 and 520, etc.

Accordingly, also with the printer of the second illustrative embodiment, in the same way as in the printer of the first illustrative embodiment, it is possible to easily draw the drawer 4 from the apparatus main body in which the photosensitive drums 5 and the process cartridges 8 are provided, and to realize downsizing of the apparatus.

Further, in this printer, the clutch mechanism 700 can be downsized due to the first gear 611B and the second gear 612A, and the gear distance changing mechanism (the first gear supporting parts 703, the first guide surfaces 701, and the second guide surfaces 702), thereby it is possible to achieve downsizing of the apparatus. Further, in the clutch mechanism 700 having the above-described configuration, it is possible to greatly reduce the number of components due to the first gear 611B and the second gear 612A, and it is possible to greatly simplify the configuration, thereby it is possible to achieve even greater manufacturing cost reductions. Further, in the clutch mechanism 700 having the above-described configuration, since the first gear 611B and the second gear 612A are simply two-layered, it is easy to narrow a device width of the printer.

The present invention has been described above in accordance with the first and second illustrative embodiments. However, the present invention is not limited to the above-described first and second illustrative embodiments, and appropriate modifications can be applied within a range which does not deviate from the spirit of the invention.

For example, the interlocking mechanism may cause a change in form such as enlargement, reduction, or bending while interlocking with opening of the cover.

Further, the apparatus may be configured such that the second gear 612A comes close to or is separated from the first gear 611B in the second illustrative embodiment.

Further, the apparatus may be configured such that the drawn positions are the spacing positions.

What is claimed is:

1. An image forming apparatus comprising:

an apparatus main body having an opening;

a drawer which is provided to be loadable to and drawable from the apparatus main body through the opening;

an image carrier which is held by the drawer and on which an electrostatic latent image is formed;

a developing unit which is provided to be movable with respect to the drawer, and which is configured to supply toner to the image carrier to make the electrostatic latent image into a visible image;

a contacting and spacing mechanism which is provided to at least one of the apparatus main body and the drawer, and which is configured to move the developing unit between a contacting position at which the developing unit contacts the image carrier and a spacing position at which the developing unit is spaced from the image carrier, in a state where the drawer is loaded in the apparatus main body;

a driving unit which is provided in the apparatus main body, and which is configured to drive the contacting and spacing mechanism in a state where the driving unit is in a coupled state with the contacting and spacing mechanism;

a cover which is configured to cover the opening, and which is opened when the drawer is drawn from the apparatus main body; and an interlocking mechanism which is configured to change in at least one of position, posture, and form thereof while interlocking with opening of the cover, wherein while the change of the interlocking mechanism interlocking with opening of the cover is caused, the interlocking mechanism performs a first operation of releasing the coupled state between the driving unit and the contacting and spacing mechanism, and a second operation of moving the developing unit to a drawn position while interlocking with the first operation, and wherein the drawn position is a position of the developing unit with respect to the image carrier for allowing the drawer to be loaded in and drawn from the apparatus main body and is one of the contacting position and the spacing position.

2. The image forming apparatus according to claim 1, wherein the interlocking mechanism includes an arm which is coupled with the cover, wherein the arm is at a first position when the cover is closed and is displaced up to a second position while interlocking with opening of the cover, wherein the arm has a first acting part and a second acting part, wherein the first acting part is configured to perform the first operation while the arm is displaced from the first position toward the second position, and wherein the second acting part is configured to perform the second operation while the arm is displaced from the first position toward the second position.

3. The image forming apparatus according to claim 2, wherein the first acting part is configured to cause the driving unit and the contacting and spacing mechanism to be in the coupled state by the arm being displaced from the second position toward the first position while interlocking with closing of the cover.

4. The image forming apparatus according to claim 2,
wherein the second acting part is configured to contact the contacting and spacing mechanism to move the developing unit to the drawn position by further displacing the arm toward the second position after the first acting part has released the coupled state.

5. The image forming apparatus according to claim 2,
wherein the contacting and spacing mechanism includes a translation cam mechanism that is configured to reciprocate in a straight direction to move the developing unit between the contacting position and the spacing position, and
wherein the translation cam mechanism includes:
a rack gear part which extends in the straight direction and which is configured to receive driving force from the driving unit; and
a pressed part which is configured to be pressed by the second acting part to be displaced in the straight direction.

6. The image forming apparatus according to claim 5, further comprising:
a swing shaft which is provided on a lower end part of the arm, and which is supported swingably by the apparatus main body at a position below a locus of displacement of the pressed part according to reciprocating of the translation cam mechanism; and
an input part which is provided on an upper end part of the arm, and to which an opening operation of the cover is input at a position above the locus of displacement of the pressed part,
wherein the second acting part is provided between the swing shaft and the input part.

7. The image forming apparatus according to claim 5,
wherein the driving unit includes:
an electric motor;
a driving transmission unit which is configured to transmit driving force of the electric motor to the rack gear part; and
a clutch mechanism which is configured to discontinue the transmission of the driving force to the rack gear part by the driving transmission unit.

8. The image forming apparatus according to claim 7,
wherein the clutch mechanism includes:
a differential gear which is provided in series in the middle of a path for transmitting the driving force from the electric motor to the rack gear part in the driving transmission unit; and
a displacement member which is coupled with the first acting part, and which is displaced according to displacement of the first acting part to engage with or separate from the differential gear,
wherein the clutch mechanism is configured to discontinue the transmission of the driving force by allowing the differential gear to rotate while the displacement member separates from the differential gear, and is configured to allow the transmission of the driving force by prohibiting the differential gear from rotating while the displacement member engages with the differential gear.

9. The image forming apparatus according to claim 7,
wherein the clutch mechanism includes:
a first gear and a second gear which are provided in series in the middle of a path for transmitting the driving force from the electric motor to the rack gear part in the driving transmission unit; and
a gear distance changing mechanism which is configured to cause the first gear and the second gear to move closer to each other and separate from each other according to displacement of the first acting part, and
wherein the clutch mechanism is configured to discontinue the transmission of the driving force by the first gear and the second gear not meshing with each other while the gear distance changing mechanism causes the first gear and the second gear to separate from each other, and is configured to allow the transmission of the driving force by the first gear and the second gear meshing with each other while the gear distance changing mechanism causes the first gear and the second gear to move closer to each other.

10. The image forming apparatus according to claim 9,
wherein the gear distance changing mechanism includes:
a first gear supporting part which is provided in the apparatus main body, and which allows the first gear to move closer to or separate from the second gear while supporting the first gear rotatably;
a first guide surface which is provided in the first acting part, and which is configured to slidingly contact the first gear to press the first gear so that the first gear separates from the second gear while the arm is displaced from the first position toward the second position; and
a second guide surface which is provided in the first acting part, and which is configured to slidingly contact the first gear to press the first gear so that the first gear moves closer to the second gear while the arm is displaced from the second position toward the first position.

11. The image forming apparatus according to claim 1,
wherein the drawn position is the contacting position, and
wherein the drawer includes a contacting mechanism which configures the contacting and spacing mechanism, and which is configured to move the developing unit to the contacting position in a state where the drawer is loaded in the apparatus main body, and hold the developing unit at the contacting position in the course of drawing the drawer from the apparatus main body.

* * * * *